US006305482B1

(12) United States Patent
Aumann et al.

(10) Patent No.: US 6,305,482 B1
(45) Date of Patent: Oct. 23, 2001

(54) METHOD AND APPARATUS FOR TRANSFERRING CORE SAMPLE FROM CORE RETRIEVAL CHAMBER UNDER PRESSURE FOR TRANSPORT

(76) Inventors: James T. Aumann, 855 S. 600 West, #102, Heber City, UT (US) 84032; Craig R. Hyland, 3757 S. Adams Rd., Magna, UT (US) 84044

( * ) Notice: Subject to any disclaimer, the term of this patent is extended or adjusted under 35 U.S.C. 154(b) by 0 days.

(21) Appl. No.: 09/607,608

(22) Filed: Jun. 30, 2000

Related U.S. Application Data

(62) Division of application No. 09/124,406, filed on Jul. 29, 1998, now Pat. No. 6,216,804.

(51) Int. Cl.[7] ..... E21B 49/00

(52) U.S. Cl. ..... 175/58; 175/20; 175/244; 175/249; 73/864.44; 73/864.91

(58) Field of Search ..... 175/20, 58, 59, 175/233, 244, 249; 73/864.44, 864.59, 864.82–864.84, 864.85, 864.91

(56) References Cited

U.S. PATENT DOCUMENTS

| | | | | |
|---|---|---|---|---|
| 2,248,910 | | 7/1941 | Auld et al. . | |
| 2,412,915 | | 12/1946 | Sewell . | |
| 2,541,785 | | 2/1951 | Smith . | |
| 2,664,269 | * | 12/1953 | Knight et al. | 175/20 |
| 2,734,719 | | 2/1956 | Otway . | |
| 2,812,160 | | 11/1957 | West et al. . | |
| 3,047,081 | | 7/1962 | Pitcher . | |
| 3,064,742 | | 11/1962 | Bridwell . | |
| 3,103,981 | | 9/1963 | Harper . | |
| 3,146,837 | | 9/1964 | Bridwell . | |
| 3,305,033 | | 2/1967 | Pickard et al. . | |
| 3,318,394 | | 5/1967 | Gleason, Jr. et al. . | |
| 3,420,322 | | 1/1969 | Mark . | |
| 3,540,537 | | 11/1970 | Brown . | |
| 3,548,958 | | 12/1970 | Blackwell et al. . | |
| 3,596,723 | | 8/1971 | Elenburg . | |
| 3,603,413 | | 9/1971 | Grill et al. . | |
| 3,627,067 | | 12/1971 | Martinsen . | |
| 3,667,553 | * | 6/1972 | Gill | 175/20 X |
| 3,667,558 | | 6/1972 | Labot . | |
| 3,739,865 | | 6/1973 | Wolda . | |
| 3,768,547 | | 10/1973 | Best . | |
| 3,777,826 | | 12/1973 | Wolda . | |
| 3,804,438 | | 4/1974 | Humphries et al. . | |
| 3,874,465 | | 4/1975 | Young et al. . | |
| 4,014,393 | | 3/1977 | Hensel, Jr. . | |
| 4,047,093 | | 9/1977 | Levoy . | |
| 4,071,099 | | 1/1978 | Hensel, Jr. . | |
| 4,071,153 | * | 1/1978 | Booher | 214/82 |
| 4,142,594 | * | 3/1979 | Thompson et al. | 175/59 |
| 4,230,192 | | 10/1980 | Pfannkuche . | |

(List continued on next page.)

FOREIGN PATENT DOCUMENTS

| | | | | |
|---|---|---|---|---|
| 2054703-A | * | 7/1980 | (GB) | 175/59 |
| 2 171 433 | | 8/1986 | (GB) . | |

*Primary Examiner*—David Bagnell
*Assistant Examiner*—Jong-Suk Lee
(74) *Attorney, Agent, or Firm*—Morriss, Bateman, O'Bryant & Compagni

(57) ABSTRACT

A pressure and temperature core sampler comprises a tool for recovering cores specifically enabling the evaluation of methane hydrate resources. Because methane hydrate tends to decompose under conditions of pressure decrease and/or temperature increase as the samples are retrieved to the surface, a coring tool in accordance with the present invention provides a self-contained system for retrieving core samples at or near in situ pressure while cooling the core sample. The coring tool is preferably a wire line retrievable device that provides for nearly continuous coring during the drilling operation.

20 Claims, 13 Drawing Sheets

U.S. PATENT DOCUMENTS 4,256,192 3/1981 Aumann .
4,258,803 * 3/1981 Thompson et al. ..... 175/233
4,311,201 * 1/1982 Stewart et al. ..... 175/44
4,317,490 3/1982 Milberger et al. .
4,356,872 11/1982 Hyland .
4,371,045 2/1983 McGuire et al. .
4,449,594 5/1984 Sparks .
4,452,321 6/1984 Eriksson .
4,456,079 6/1984 Rassieur .
4,466,495 8/1984 Jageler .
4,466,497 8/1984 Soinski et al. .
4,479,557 10/1984 Park et al. .
4,512,419 4/1985 Rowley et al. .
4,573,539 3/1986 Carroll et al. .
4,598,777 7/1986 Park et al. .
4,624,929 * 11/1986 Ullman ..... 73/864.91 X
4,638,872 1/1987 Park et al. .
4,669,299 6/1987 Closmann .
4,679,636 7/1987 Ruhle .
4,716,974 1/1988 Radford et al. .
4,735,269 4/1988 Park et al. .
4,784,902 11/1988 Crompton .
4,800,969 1/1989 Thompson .
4,817,718 4/1989 Nelson et al. .
4,826,354 5/1989 Adorjan .
4,834,198 5/1989 Thompson .
4,949,582 * 8/1990 Vollweiler ..... 73/804.63
4,989,678 * 2/1991 Thompson ..... 175/20
5,005,433 * 4/1991 Patton ..... 73/864.91 X
5,154,328 * 10/1992 Gueret ..... 222/494
5,209,310 5/1993 Clydesdale .
5,230,390 7/1993 Zastresek et al. .
5,253,720 10/1993 Radford et al. .
5,263,360 11/1993 Blauch et al. .
5,267,620 12/1993 Lee .
5,325,930 7/1994 Harrison .
5,339,915 8/1994 Laporte et al. .
5,351,765 10/1994 Ormsby .
5,360,074 11/1994 Collee et al. .
5,482,123 1/1996 Collee .
5,488,876 * 2/1996 Casey et al. ..... 73/864.44
5,505,098 * 4/1996 Turriff et al. ..... 73/864.44
5,517,868 * 5/1996 Turriff et al. ..... 73/864.44
5,546,798 8/1996 Collee et al. .
5,560,438 10/1996 Collee et al. .
5,568,838 10/1996 Struthers et al. .
5,644,091 * 7/1997 Jacq et al. ..... 73/864.44
5,667,025 9/1997 Haessly et al. .
5,691,488 * 11/1997 Giannone ..... 73/863.86
5,816,314 10/1998 Wiggs .
6,000,438 12/1999 Ohrn .

* cited by examiner

METHOD AND APPARATUS FOR TRANSFERRING CORE SAMPLE FROM CORE RETRIEVAL CHAMBER UNDER PRESSURE FOR TRANSPORT

CROSS REFERENCES TO RELATED APPLICATIONS

The present invention is divisional of U.S. patent application Ser. No. 09/124,406 filed Jul. 29, 1998, now U.S. Pat. No. 6,216,804.

BACKGROUND

1. Field of the Invention

The present invention relates generally to a method and apparatus for retrieving subterranean core samples under pressure and, more specifically to a method and apparatus for recovering core samples under insitu pressure and temperature.

2. Background of the Invention

The recovery of subterranean, geologic samples is commonly performed by an operation or technique referred to as coring. This technique has evolved from simple single tube systems to dual tube systems that are most commonly used in the mining and petroleum industry today. Because such coring techniques are employed for recovery of volatile components contained within rock samples, various modifications have been made to conventional coring devices in order, for example, to retain formation pressure on the core during recovery.

In order to accurately analyze the composition of certain volatile core samples, the core sample must maintain its chemical, mechanical, and/or physical integrity during the retrieval process. Downhole, water or other substances in the formation may contain dissolved gases which are maintained in solution by the extreme pressure exerted on the fluids when they are in the formation. Thus, unless a pressure core barrel is employed during the core extraction process, the pressure on the core at the surface will differ dramatically from the pressure experienced on the core sample downhole. Furthermore, as the pressure on the core sample decreases, fluids in the core will expand and any gas dissolved therein will come out of solution. Accordingly, the retrieved core sample will not accurately represent the composition of the downhole formation.

One common method of retaining core integrity is known as pressure coring. Pressure coring utilizes various apparatuses to maintain the core sample at or near formation pressure as the core is retrieved to the surface. Core sampling tools that include pressurized core barrels have been known for several decades. For example, U.S. Pat. No. 2,248,910 to D. W. Auld et al. entitled "PRESSURE RETAINING CORE BARREL" discloses a core barrel that is sealed downhole to maintain the core at downhole pressure. U.S. Pat. No. 3,548,958 to Blackwall et al. discloses another pressure core barrel that utilizes a compressed gas system to maintain pressure on the core sample during the core retrieval process. U.S. Pat. No. 4,317,490 to Milberger et al. discloses yet another pressurized core barrel in which a ball valve, actuated from the surface is employed to trap ambient pressure in the core barrel while downhole. U.S. Pat. No. 4,466,495 to Jageler discloses a pressure core barrel of a sidewall coring tool. Other pressure core barrels are disclosed in U.S. Pat. No. 4,356,872 to Hyland, U.S. Pat. No. 4,256,192 to Aumann, the inventor of the present invention, U.S. Pat. No. 4,230,192 to Pfannkuche, U.S. Pat. No. 4,142,594 to Thompson et al., U.S. Pat. No. 4,014,393 to Hensel, Jr., and U.S. Pat. No. 4,735,269 to Park et al. Pressure core barrels often utilize pressure actuation to release a latch and/or mechanical manipulation of the drill pipe to close a valve and also often require the entire core barrel to be brought to the surface to recover the core.

Encapsulation is another technique known in the art to maintain the integrity of unconsolidated or friable core samples. In U.S. Pat. No. 4,449,594 to Sparks, a foam is introduced into the well under a correlated control pressure. The core sample is thus encapsulated while the reservoir pressure within the sample is balanced by the bottom hole foam balance pressure to produce a balanced, pressurized core sample. Another method of encapsulating a core sample is disclosed in U.S. Pat. No. 4,716,974 to Radford et al. in which a liquid foam is allowed to cure to form a sponge-like solid that retains oil as the core is depressurized during retrieval. Another attempt to stabilize cores where unconsolidated and friable columnar masses of earth can be handled without altering the characteristics of its physical structure employs a rubber sleeve that encapsulates the core sample. A housing is provided for positioning the ensleeved core therein and subfreezing material is circulated around the ensleeved core to freeze and solidify the core fluids contained therein. Likewise, in U.S. Pat. Nos. 5,360,074, 5,560,438, 5,546,798, and 5,482,123 to Collee et al., methods for maintaining the mechanical integrity and for maximizing the chemical integrity of a core sample during transport from a subterranean formation to the surface comprises employing an encapsulating material that increases in viscosity or even solidifies at temperatures slightly lower than those expected downhole. The patents to Collee note that in such a method of encapsulation, the chemical integrity of the core sample can be further increased by using a pressure core barrel.

Certain core samples, however, such as cores containing methane hydrate, not only require that the core sample be maintained at formation pressure when brought to the surface for examination and testing, but because methane hydrate is a material stable only within a limited pressure/temperature range, the core sample must also be maintained at formation temperature during recovery. If the core sample is allowed to become heated above this pressure/temperature envelope during the extraction process, the structural and physical makeup of the sample will be partially if not totally lost.

One attempt in the art to retrieve methane hydrate cores is disclosed in U.S. Pat. No. 4,371,045 to McGuire et al. As described, the cores are cooled down to at least −80 degrees C. at which temperature the pressure of methane hydrates is 1 atmosphere. Such cooling is accomplished by employing a conventional wire line retrievable core barrel having perforations therein through which cryogenic liquid passes into direct contact with the hydrocarbon hydrates and thus thermodynamically stabilizes the core. The invention employs an insulated chilling vessel into which the perforated core barrel and thus the core sample is moved for cryogenic freezing.

Many of the aforementioned coring apparatuses employ valves or other sealing devices to isolate the core. For example, a common method of preventing fluid access to the inner tube of a core barrel assembly is provided in U.S. Pat. No. 5,230,390 to Zastresek et al. in which a closure mechanism is configured to move from an open condition to a closed condition in response to increased fluid flow rates and pressure differentials occurring at the closure mechanism. Likewise, U.S. Pat. No. 5,253,720 to Radford et al. discloses a coring device in which a ball valve is actuated to seal off the core barrel before the core barrel is pulled to the surface.

It is also noted, that wire line retrieval of core barrels and/or manipulation of various components of the coring apparatus has previously been employed in many of these systems. For example, in U.S. Pat. No. 3,627,067 to Martinsen, a core-drilling system is disclosed in which selective or controlled release of an overshot from the core barrel while downhole is performed by pumping a wire line to which the overshot is attached up and down a prescribed number of times. In U.S. Pat. No. 3,667,558 to Lambot, an upward pull on a cable unlatches the coring head and also vents water under pressure so that it no longer forces the assembly downward. Continued pulling on the cable retrieves the coring head and the core sample. U.S. Pat. No. 3,739,865 to Wolda, discloses a wire line core barrel system that includes flexible latch fingers and provides a predetermined pressure signal indicating latching and further blocks fluid flow until the core barrel is properly latched. U.S. Pat. No. 4,800,969 discloses yet another wire line core barrel assembly in which an inner tube assembly can move down faster than the fluid flow in the drill stem during the time the inner tube assembly moves downwardly in the drill stem. U.S. Pat. No. 4,466,497 to Soinski et al. discloses yet another wire line core barrel apparatus.

Other coring systems and devices are known such as the coring apparatus disclosed in U.S. Pat. No. 3,874,465 to Young et al. in which core samples of relatively soft formations may be retrieved. The coring apparatus comprises a core barrel with an interior surface having properties similar to synthetic rubber, two semi-tubular rigid portions joined along the adjacent edges by a flexible material, and a core catcher having a plurality of flexible segments adapted to open while the core is being drilled and to close when the core is to be recovered. A latch for retaining the tool in position within the coring bit and a swivel allowing the core barrel and catcher to remain stationary while the coring bit is rotated are also provided.

While the aforementioned references disclose various methods and apparatuses for retrieving core samples of subterranean formations, these methods are inadequate to maintain a core sample at least partially comprised of methane hydrate at its downhole state. U.S. Pat. No. 4,371,045, which is specifically directed to the problem of stabilizing hydrocarbon cores, requires that the core be quickly brought to the surface before cryogenic freezing of the core is performed. Thus, it would be advantageous to provide a method and apparatus for retrieving core samples that are or become unstable when removed from the downhole environment. Such a coring method and apparatus may be applicable to not only obtaining core samples of formations containing hydrocarbons, but may have utility in other coring applications where the core samples may be unconsolidated, friable, or comprised of frozen material that would otherwise not maintain their chemical or mechanical properties once exposed to ambient pressures and temperatures. In addition, the methods and apparatuses disclosed herein may have applicability to other coring devices regardless of the type of formation from which the core sample is being taken.

SUMMARY OF THE INVENTION

Accordingly, it is an object of the present invention to provide a method and apparatus for retrieving geological core samples in which the core samples are recovered at in situ pressure.

It is another object of the present invention to provide a method and apparatus for retrieving geological core samples in which the integrity of the core sample is maintained by cooling the core sample as it is brought to the surface.

It is an object of the present invention to provide a method and apparatus for retrieving geological core samples in which heat is diverted away from the core.

It is yet another object of the present invention to provide a method and apparatus for retrieving geological core samples in which the core sample can be safely extracted into a transfer, storage, or other laboratory container while maintaining in situ pressure on the core.

It is still another object of the present invention to provide a method and apparatus for retrieving geological core samples in which the system is easily repairable.

Another object of the present invention is to provide a method and apparatus for retrieving geological core samples in a nearly continuous coring operation in which downtime is significantly reduced.

Still another object of the present invention is to provide a method and apparatus for retrieving geological core samples in which the system is reliable and relatively easy to test, maintain, and operate.

Yet another object of the present invention is to provide a method and apparatus for retrieving geological core samples in which the system is capable of various modes of operation depending on the needs of the operator.

Additional objects and advantages of the present invention will be apparent from the description and claims which follow or may be learned by practicing the invention.

Accordingly, the foregoing objects and advantages are realized in an improved method for coring and coring tools for recovering core samples under pressure comprising an inner barrel having a first end and a second end. A remotely actuable valve is connected to the inner barrel at the second end and a removable plug is attached to the first end of the inner barrel. The inner barrel, the valve, and the plug define a pressure or core sample chamber.

The coring tool further includes a cooling system associated with the inner barrel for cooling the inner barrel during retrieval of the core sample to the surface. Preferably, the cooling system comprises a plurality of thermal electric coolers which cool an inner tube of the inner barrel. The thermal electric coolers are thus disposed along a portion of the inner tube.

In another preferred embodiment, the cooling system comprises a plurality of heat pipes extending around and along the inner tube of the inner barrel. The heat pipes may be contoured to match the shape of the inner tube for maximum efficiency in extracting heat from the inner tube.

The cooling system may also include a power source for providing electric current to a plurality of cooling elements and for providing power to a pump employed to circulate a coolant through the heat pipes.

The coring tool further preferably includes a core catcher associated with the inner barrel at an end thereof for holding a core sample within the inner barrel as the inner barrel is lifted relative to the borehole bottom. The core catcher may be comprised of a dog catcher, a basket catcher, or other types of core catchers known in the art.

The coring tool is further preferably provided with a pressure system for maintaining the pressure of the core sample at or near in situ pressure during the recovery operation when the core sample is brought to the surface. In a preferred embodiment, the pressure system comprises a piston disposed and slidable within an elongate chamber. The elongate chamber is in fluid communication with the core sample chamber at the end of the elongate chamber nearest the core sample chamber.

Preferably, the coring tool includes an outer barrel disposed about an inner barrel and further includes a coring bit secured to a distal end of the outer barrel. A sub is provided which secures the outer barrel to the inner barrel. The inner barrel comprises an outer tube and an inner tube. A swivel mechanism is preferably interposed between the outer tube and the inner tube to allow the outer tube to rotate with the rotation of the outer barrel and drill bit during drilling operations while the inner barrel system remains relatively stationary.

In a preferred embodiment, the inner barrel system comprises the core catcher, the core sample or pressure chamber, the pressure control system, and the temperature control system. The inner tube is selectively longitudinally movable relative to the outer tube for lifting the core and closing the valve. Preferably, the valve is a ball valve comprising a ball housing, a ball having a bore extending therethrough and pivotally disposed within the ball housing, and a linkage mechanism interconnected between the ball and the outer tube for closing the ball when the outer tube moves longitudinally relative to the inner tube. A catch mechanism is also provided for engaging a ball valve operator when the inner tube assembly is longitudinally moved relative to the outer tube assembly. The catch mechanism is preferably spaced a sufficient distance from an engageable point of the ball valve operator to allow a distal end of a core sample to pass completely through the ball valve before the ball valve is closed.

This relative longitudinal movement is preferably accomplished by employing selectively releasable latching mechanisms for selectively securing the inner tube system to the outer tube system. In addition, the inner barrel is longitudinally movable relative to the outer barrel for recovering the inner barrel while leaving the outer barrel downhole. This relative longitudinal movement is also preferably accomplished by employing a second selectively releasable latching mechanism for selectively securing at least a portion of the inner barrel to the outer barrel.

In order to keep the core sample adequately cool during extraction, the coring tool in accordance with the present invention preferably comprises an inner tube having a layer of insulation disposed substantially around the inner tube and an outer shell disposed substantially around the layer of insulation. The cooling system is associated with the inner tube for cooling the inner tube and thus removing heat therefrom. Because heat may be conducted away from the inner tube the inner tube is preferably comprised of a metal material. In addition, the layer of insulation may be comprised of a foam material or an evacuated annular chamber. In order to strengthen the inner tube so that it is less susceptible to downhole hydrostatic pressures, the outer shell may be comprised of steel and/or a layer of glass or carbon fiber and epoxy. A second layer of carbon fiber and epoxy may also be disposed over the inner tube.

Preferably, the coring system in accordance with the present invention includes a wireline latching system for operating the coring tool. As such, a first latching mechanism interposed between the outer barrel and the inner barrel may, by wireline, selectively latch the outer barrel to the inner barrel. Moreover, a second latching mechanism interposed between the outer tube and the inner tube may be employed for selectively latching the outer tube to the inner tube. A wireline pulling tool configured to be selectively engageable with a proximal end of the inner barrel is configured to disengage the second latching mechanism and longitudinally move the inner tube relative to the outer tube. The wireline pulling tool is also configured to disengage the first latching mechanism and retrieve the inner barrel relative to said outer barrel. A second wireline pulling tool is configured to be selectively engageable with a proximal end of the inner barrel and to leave the second latching mechanism in an engaged position locking the inner tube relative to the outer tube and to disengage the first latching mechanism and retrieve the inner barrel relative to the outer barrel.

In operation, geological core samples are retrieved by drilling a core sample, lifting the core sample into a chamber, sealing the chamber around the core sample, retrieving the chamber and core sample contained therein while leaving an associated outer barrel and drill bit downhole, and cooling the chamber as the chamber and core sample contained therein are brought to the surface. Drilling is preferably accomplished by rotating the outer barrel assembly and a drill bit attached thereto into a subterranean formation while allowing the inner barrel assembly to remain substantially rotationally stationary relative to the formation. When drilling is complete, the chamber is unlatched from the inner barrel assembly and the chamber is lifted relative to the inner barrel assembly until the core sample is contained within the chamber. The core sample is then sealed within the chamber by closing a pressure tight valve to seal the core sample within the chamber. The core sample is then recovered by unlatching the inner barrel assembly from the outer barrel assembly and raising the inner barrel assembly to the surface. Preferably, these operations are accomplished by employing a wireline tool.

Once the chamber containing the core sample has been brought to the surface, a transport container is attached to the core chamber and the core sample is transferred from the core chamber to the transport container. Preferably, this transferring process is performed while maintaining the core sample under pressure.

In a preferred embodiment, the transport container has a distal end configured to mate with a proximal end of the pressurized core retrieval chamber and an actuable sealing device, such as a ball valve, associated with a distal end of the transport container for selectively forming a substantially pressure tight chamber within the transport container. A transferring device, such as a hydraulic telescoping piston arrangement, is also provided having a proximal end configured to mate with a distal end of the pressurized core retrieval chamber. The transferring device includes an extendable member for extending through the pressurized core chamber to force a core sample therein into the transport container. Preferably, transport container has an internal diameter substantially the same as an inside diameter of the core chamber. The transport container also preferably includes means for regulating the pressure within said transport container, such as an external or internal pressure source.

In operation, the core sample is transferred from a core retrieval chamber under in situ pressure by attaching a transport container to a first end of the core retrieval chamber, attaching a transferring device to a second end of the core retrieval chamber, opening the first end of the core retrieval chamber, opening the second end of the core retrieval chamber, forcing the core sample from the core retrieval chamber into the transport container with the transferring device, and sealing the transport container around the core sample. In a preferred embodiment, opening the first end comprises releasing a sealing plug from the core retrieval chamber. Thus, the plug is configured to be removable relative to the inner tube assembly such that a core sample contained within the inner tube assembly is removable through the proximal end of the inner tube assembly. In addition, it is preferable that the system be configured to allow these operations to be performed by external manipulation of the apparatus.

In order to more fully understand the manner in which the above-recited objects and advantages of the invention are obtained, a more particular description of the invention will be rendered by reference to the presently preferred embodiments or presently understood best mode thereof which are illustrated in the appended drawings.

BRIEF DESCRIPTION OF THE DRAWINGS

The embodiments illustrated in the following drawings are provided by way of example of the preferred embodiments of the invention and are therefore not to be considered limiting the scope of the present invention, in which.

DETAILED DESCRIPTION OF THE PREFERRED EMBODIMENTS OF THE PRESENT INVENTION

Figure 1:
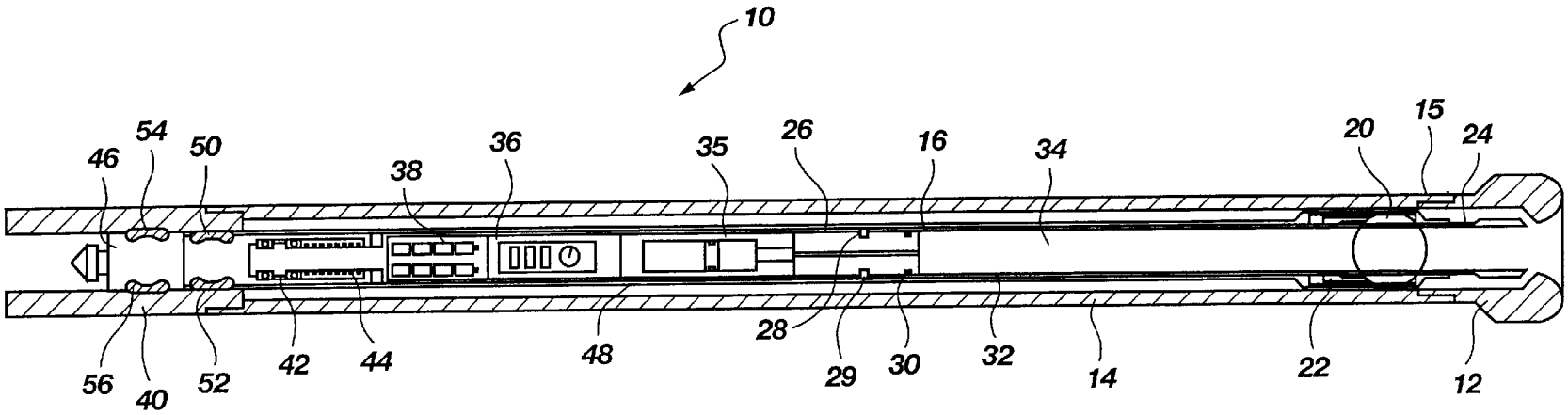
FIG. 1 is a partial cross-sectional side view of a first preferred embodiment of a coring device in accordance with the present invention.

Referring to FIG. 1, a coring device, generally indicated at 10, for retrieving geological core samples generally comprises a coring bit 12 which is attached to the distal end 15 of an outer barrel 14 having a generally cylindrical configuration. With the coring tool 10 of the present invention, coring can proceed in a normal fashion. Rotary speed and bit weight will of course vary by rock formation and bit type. An inner tube 16 is retained within the outer barrel 14 and is provided with a ball valve 20 and associated ball valve operator 22 at its lower end 24. An inner tube plug 26 is held within the inner tube 16 with retaining pins 28 and 29 and is sealed with O-ring 30 to the inner surface 32 of the inner tube 16. The inner tube 16, inner tube plug 26, and ball valve 20, when closed, define a pressure or core chamber 34 for retaining a core sample at in situ pressure when contained therein. A pressure control system 35 is connected to the inner tube plug 26 to control the pressure within the chamber 34 during recovery of a core sample.

The inner tube 16 is also provided with a cooling system comprised of an electronics system 36, a power supply 38, and coolers (not visible). The cooling system is associated with the inner tube 16 to maintain a core sample at or near in situ temperature. The inner tube 16 and outer barrel 14 are each connected to a landing sub 40, the landing sub 40 being connected to a drill string (not shown) as is known in the art. The inner tube 16 is connected to the landing sub with a swivel device 42 which allows the inner tube 16 to remain relatively stationary with respect to the formation being drilled while the outer barrel 14, inner barrel 48, and bit 12 rotate. A biasing device 44, such as a coil spring, is associated with the swivel device 42 to protect the ball valve 20 during operation. A wireline retrievable section 46, or latch housing, is connected to the swivel device 42 and to the inner barrel 48 which extends from proximate the swivel device 42 to proximate the ball valve 20.

The inner barrel 48 is provided with latching mechanisms 50 and 52, which during the drilling operation hold the inner barrel 48 relative to the swivel mechanism 42. In addition, latching mechanism 54 and 56 maintain the wireline retrievable section 46 relative to the landing sub 40. The latching mechanisms 50 and 52 are employed to maintain the inner barrel 48 relative to the inner tube 16 during the drilling operation and thus the ball valve 20 in an open position. After the desired length of core has been cut from the formation, the latching mechanisms 50 and 52 are disengaged to allow the inner tube 16 to move relative to the inner barrel 48 and thus close the ball valve 20, trapping the core sample within the chamber 34 at in situ pressure. The latching mechanisms 54 and 56 are then disengaged from the landing sub 40 so that the inner tube 16 and core sample can be tripped to the surface while leaving the outer barrel 14 and bit 12 downhole for use with an empty inner barrel assembly.

Figure 2A:
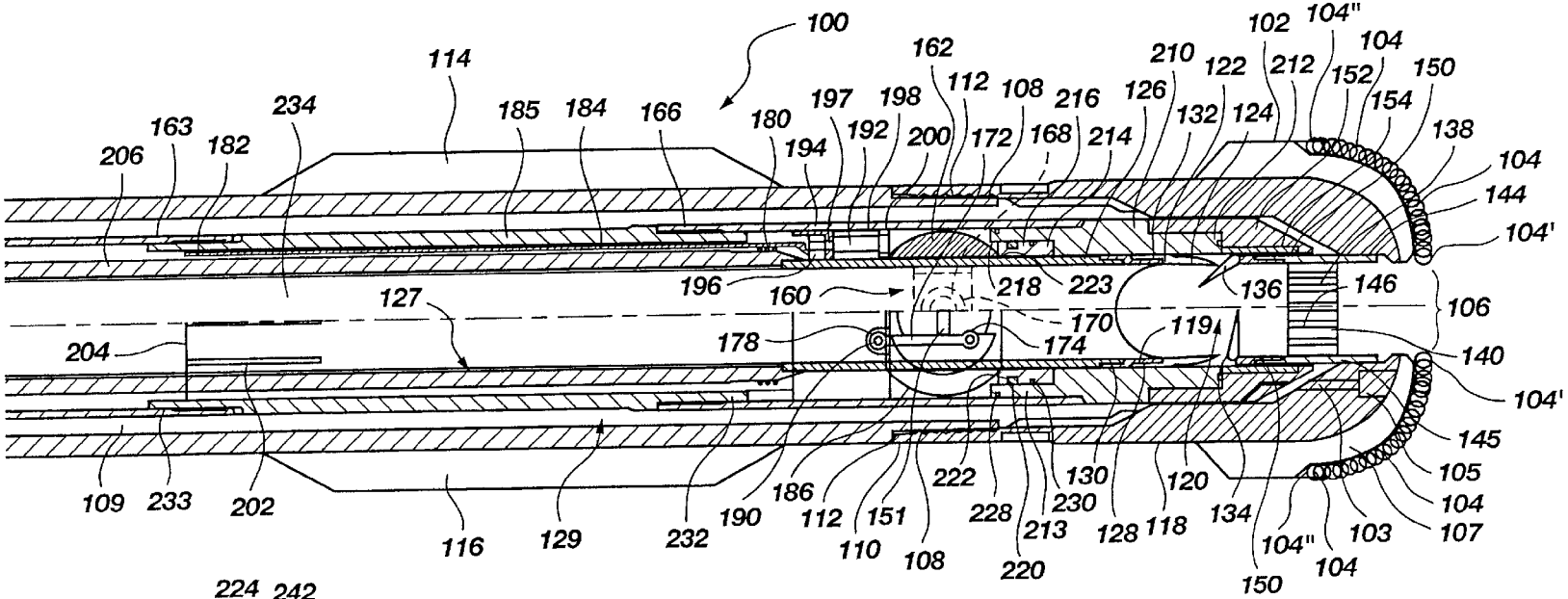
FIGS. 2A, 2C, 2D, 2E, 2F, and 2G are different sections of a cross-sectional side view of a second preferred embodiment of a coring device in accordance with the present invention.

Referring now to FIG. 2A, a preferred embodiment of the distal end of a coring device, generally indicated at 100, in accordance with the present invention is illustrated. The coring device 100 includes a coring bit 102 having a plurality of cutting elements 104 secured thereto positioned along the perimeter of the bit 102 for cutting into the formation. The distance between the innermost cutting elements 104' define the diameter of the core that will be cut with such a bit 102. The cutting elements 104" also define an outer diameter which will cut the borehole to a size sufficient to allow the rest of the coring tool 100 to enter the borehole. The bit 102 is provided with a plurality of fluid passageways 103 in fluid communication with the space 109 defined between the outer tube 163 and the stabilizer 106, to which nozzles 105 are attached to direct drilling fluid to the cutting elements 104. The drilling fluid keeps the cutting elements 104 cool and moves formation chips generated by the cutting elements 104 through the junk slots 107, which are positioned adjacent the cutting elements 104, and back to the surface through the space provided between the coring tool 100 and the borehole. Of course, after reviewing the present invention, those skilled in the art will understand that various types and configurations of coring bits may be employed with the present invention so long as the bit can cut a core sample having an outer diameter that will fit within the coring tool 100. The bit 102 is attached to a bit stabilizer 106 with internal threads 108 on the proximal end 110 of the bit 102 that threadedly engage with external threads 112 on the stabilizer 106. The stabilizer 106 includes one or more stabilizing portions 114 and 116 that define a diameter substantially equal to the diameter of the borehole cut by the outermost cutters 104", commonly referred to as gage cutters. The stabilizing portions 114 and 116 of the stabilizer 106 ride against the surface of the borehole during the drilling operation and help maintain the general drilling direction of the bit 102 into the formation. Basically, from an exterior view at least the distal end 118 of the coring tool 100 appears similar in configuration to other coring tools known in the art.

As further illustrated in FIG. 2A, the coring tool 100 further comprises one or more core catching assemblies, generally indicated at 120. The core catchers 120 are located at the distal end 118 of the coring tool 100 and are associated with the inner tube 126. The core catcher 120 allows the cut core to enter the inner tube 126 but prevents it from falling out while the core is being lifted to be severed from the bottom of the bore hole and when the inner tube 126 is lifted into the pressure chamber. Several types of core catchers 120 may be employed with the present invention. For example, a spring catcher 138, basket catcher 122 and/or dog type catcher 124 may be employed. Thus, the spring catcher 138 may include a tapered cone design which expands around the core as the core enters the inner tube 126 and thus grips the sides of the core sample. Likewise, a basket type catcher 122 can be placed in the thread relief groove 128 in the back core shoe threads 130. In addition, an upper shoe 132 can be used with or replaced by a dog type catcher assembly 124 which employs a plurality of core catching members such as core catching members 134 and 136 that fully open to allow the core to enter therethrough but close to pierce soft or unconsolidated material and thus substantially close the tube preventing the core from falling out of the tube.

With specific reference to the spring catcher 138 associated with the distal end 118 of the coring tool 100, the spring catcher 138 comprises a split tapered ring 140 that is actuatable to essentially grab the sides of a cut core sample in order to lift the core sample from the bottom and sever the core sample near the bottom of the borehole. The spring catcher 138 is actuated by the lower shoe 144 having an inwardly tapered inner surface 145 such that as the spring catcher 138 is forced toward the bottom of the borehole by the weight of the core sample being lifted. Thus, the spring catcher 138 is pressed against the core sample. The spring catcher 138 further includes a plurality of straight or helically-configured grooves 146 to provide a better surface for grasping the core sample and also to allow drilling fluid to flow between the core sample and the spring catcher 138 so as to equalize the pressure of drilling fluid contained within the coring tool 100 and that at the bottom of the bore hole and to allow drilling fluid in the inner tube 126 to escape as the core enters. A stop ring 150 is provided above and adjacent to the spring catcher 138 so as to prevent the spring catcher 138 from moving up into the core catcher 120 and inner tube 126.

As will be described in more detail, the coring tool 100 of the present invention is configured such that the outermost members, such as the stabilizer 106 and bit 102 shown in FIG. 2A, rotate in order to drill the borehole while the inner members such as the inner tube 126 and core catcher 120 substantially maintain their rotational orientation during the drilling process. Accordingly, an outer shoe 152 rotates with the bit 102 and is provided with a lower bearing 154 which allows rotation of the bit 102 relative to the inner tube 126 while maintaining the rotational orientation of the core catcher 120, core lifter 138, inner tube 126 and associated components. As such, the inner tube 126 does not generate heat from friction as would be the case if the inner tube 126 rotated relative to the cut core sample. When recovering core samples that may be in a partially frozen state, such heating would prove detrimental to recovery of such core samples as substantial temperature variations may cause the core sample to destabilize.

The coring tool 100 also includes an externally or remotely released or actuable sealing device such as a ball valve assembly, generally indicated at 160, positioned proximate the distal end 118 of the coring tool 100 and above the core catcher 120. The ball valve 160 is provided within the coring tool 100 to be closed once the core sample has passed therethrough to trap the core sample at in situ pressure. When extracting core samples containing methane hydrates, it is preferable to maintain the core sample at a pressure as close to the downhole pressure as possible in order to maintain the physical and chemical properties of the core sample.

Figure 2B:
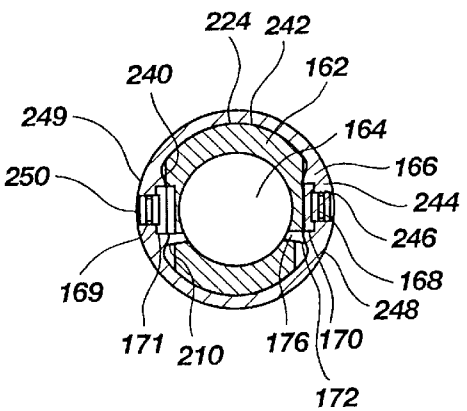
FIG. 2B is a cross-sectional view of the ball valve illustrated in FIG. 2A.

As shown in FIGS. 2A and 2B, the ball valve assembly 160 is comprised a ball 162 having a bore 164 extending therethrough, the bore 164 having a diameter sufficient to allow passage therethrough of the distal end of the inner tube 126 and the core catcher 120. The ball 162 is pivotally attached to a ball valve housing 166 with a pivot pin 168 and thrust washer 170 in which to allow rotation of the ball 162 relative to the ball valve housing 166.

The ball 162 of the ball valve 160 is actuated with one or more pivotally attached elongate members or links 172. The link 172 is attached at a first end 174 with a link pin 176 and at a second end 178. The link 172 is preferably controlled by axial motion between the outer tube 163, which is preferably threadedly connected to the operator housing 185, and the inner tube 126. As will be described in more detail, a ball valve latch assembly located at the proximal end of the coring tool 100 controls movement of the ball valve operator 184. Once the latch is released, continued pull on a wireline tool causes the inner tube 126 to retract upward through the ball 162 until a catch mechanism such as a protrusion or upset 180 on the inner tube 126 contacts a shoulder 182 in the operator 184. The operator 184 moves upward along with the inner tube 126 and pulls on the link(s) 172 rotating the ball 162 to a closed position. The spacing between the upset 180 and the shoulder 182 ensures that the ball 162 does not begin to rotate closed until the inner tube 126, core catchers 120, and core sample have completely passed through the bore 164 defined by the ball 162. Preferably, the shoulders 182 are precisely machined to ensure that rotation of the ball 162 is accurately controlled in both the fully open and fully closed position. In a preferred embodiment, the required stroke for complete ball valve rotation from a fully open position to a fully closed position is approximately 1.75 in. (44.45 mm). In addition, by knowing the distance from the top edge 186 of the ball 162 when the ball is in a fully closed position to the distal end 119 of the inner tube 126, the distance between the upset 180 and the shoulder 182 can be configured to ensure that a core sample is fully retracted through the ball 162 before the ball 162 is actuated to a closed position. In a preferred embodiment, the distance from the top 186 of the ball 162 when in a closed position to the distal end 119 of the inner tube 126 is approximately 15.8 in (401 mm). Extra travel of the upset 180 relative to the shoulder 182 may be desired to make sure that if a small portion of the core is hanging past the catcher 120, the portion of the core will not jam the ball valve 160 as it is rotated to a closed position. Therefore, a stroke length of 17 in. (432 mm) may be selected before rotating the ball valve 160 to the closed position. Accordingly, a total stroke length of 19 in. (482.6 mm) may be provided for the lower section of the inner tube 126 to retract the core completely through the ball 162 and completely close the ball valve 160.

The link 172 is pivotally linked at its second end 178 with a link pin 190 to a spring carrier member 194. A threaded fastener 192, such as a socket head shoulder screw, is secured to the distal end 196 of the operator 184. An operator biasing member 198, such as a coil spring, is interposed between the head 200 of the fastener 192 and the distal end 196 of the operator 184. The operator spring 198 may be provided with a nominal 0.25 in. (6.35 mm) travel to accommodate variations in length tolerances in the parts and while maintaining complete ball 162 closure. In addition, the operator spring 198 may provide resistance to damage of the inner tube 126. Thus, in order to prevent damage that may otherwise occur when trapped pressure in the inner tube 126 forces the inner tube shoulder 270 into the seal sub 280, small springs 198 are provided in the ball valve operator 184, which allow it to extend to reduce the resulting high stress on these components. Accordingly, the shoulders 223 near the seal 216 can engage. Thus, the force produced by the preloaded springs 198 is transmitted to these components and all of the high forces are contained within the seal carrier 214. Shoulder screws 197 are used to preload the springs 198 and limit their travel and at the same time hold the assembly together. The springs 198 are preferably arranged in an asymmetrical annular pattern which produces a force that balances the force generated by the eccentric location of the links 172.

The ball valve operator 184 is provided with a collet 202 at its upper end 204 which enables assembly by simply sliding the ball valve operator 184 over the bonded sleeve 206 on the inner tube 126. A disassembly tool (not shown) is available which opens the collet 202 to allow disassembly. The ball valve operator 184 is also provided with flats 207 (not shown) on its sides to match the ball 162. These flats fit into the non-circular inner surface 240 of the ball valve housing 166. This matching or keying prevents unwanted rotation of the parts relative to each other and also traps the links 172 on the link pins 168 without the need for any other type of retaining devices.

The ball valve 160 is held on one side within the coring tool 100 with a sealing sub 210 which, at a distal end 212 fits within the outer shoe 152 and is sealed relative to and fits within the ball valve housing 166 at the proximal end 213 of the sealing sub 210. A ball valve seat 214 fits within the proximal end 213 of the sealing sub 210. A ball valve sealing retainer 216 having a lip 218 thereon retains a ball valve seal 220 between the sealing sub 210 and the ball valve seat 214. The ball valve seal 220 includes a sealing surface 222 which contacts and forms a seal with the outer surface 224 of the ball 162. The configuration of the ball valve seal 220 and more specifically of the position of the sealing surface 222 between the ball valve seat 214 and the ball 162 promotes a tighter seal between the ball 162 and the seal 220 as the pressure differential between the pressure within the pressure chamber 234 and ambient pressure increases. In effect, the portion of the seal 220 becomes wedged between the ball 162 and the ball valve seat 214. Sealing of the ball 162 with the seal 220 is further enhanced by allowing the ball 162 to float within groove 151. Preferably, the seal 220 is comprised of a resilient material, such as a rubber compound, that is also resistant to abrasion and thus damage that may otherwise occur from movement of the ball 162 relative thereto. In addition, because the coring tool 100 includes structures to seal the core sample at in situ pressure, other sealing devices may be employed to seal the components defining the pressurized chamber relative to one another. For example, o-ring 228 positioned between the ball valve housing 166 and the sealing sub 210, o-ring 230 positioned between the sealing sub 210 and the valve seat 214, o-ring 232 interposed between the ball valve housing 166 and the operator housing 185, and o-ring 233 positioned between and sealing the operator housing 185 to the outer tube 163 are each provided to seal the various components forming the ball valve assembly 160 relative to the rest of the coring tool 100 to form a substantially air tight core chamber 234.

As specifically shown in FIG. 2B, the ball valve housing 166 has a portion 240 of the inside surface 242 milled to a non-circular cross-section. This provides a thicker wall 244 with sufficient thickness for pivot pins 168 and 169 which are inserted into holes 246 drilled into the thicker walls 244 of the ball valve housing 166. The pivot pins 168 and 169 are provided with o-ring seals 248 and 249 on their outer diameter to seal in pressure while allowing rotation. The washers 170 and 171, preferably made from glass-filled Teflon, act as thrust bearings and thus provide a low friction surface for easier manual ball valve 160 operation when a high pressure differential exists across the pivot pins 168 and 169. It is preferable that at least one of the pivot pins 168 and 169 is provided with a key on one end which engages a slot in the ball 162 and further includes a hex socket 250 in the end thereof that faces to the outside of the ball valve housing 166. Accordingly, if necessary, the ball 162 can be manually opened or closed from outside the ball valve housing 166 by placing a hex key in the socket 250 of the pivot pin 169 and rotating the hex key until the ball 162 is in the desired position. Of course, if each pivot pin 168 and 169 were provided with sockets 250, two hex keys could be employed and simultaneously rotated to operate the ball 162. It is also preferable, for safety reasons, that the pivot pins 168 and 169 be secured relative to the ball valve housing 166 such that the pivot pins 168 and 169 cannot be ejected or blown out from the ball valve housing 166 by internal pressure. Accordingly, the pivot pins 168 and 169 are installed from the inside of the ball valve housing 166 prior to installing the ball 162 and thus abut against the inside 242 of the ball valve housing 166. The pivot pins 168 and 169 are thus prevented from blowing out by the solid wall 244 of the housing 166 itself rather than by threads, snap rings or other such devices and structures.

Figure 2C:
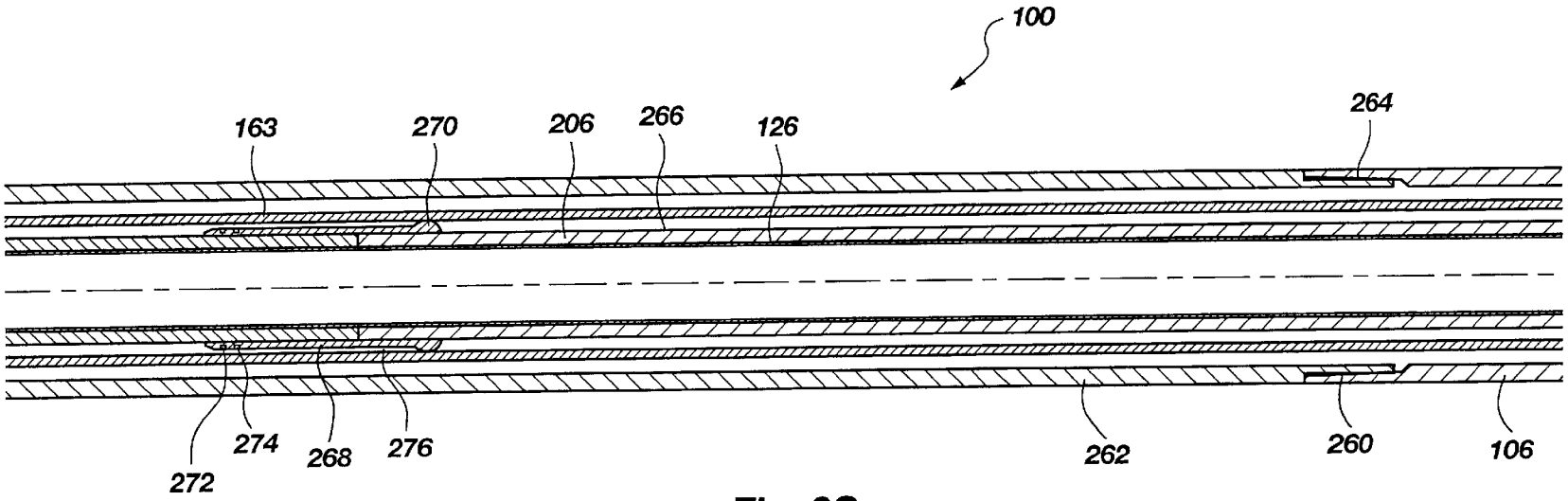

Referring now to FIG. 2C, the stabilizer 106 is attached, as with internal threads 260, to the outer barrel 262 which preferably includes an externally threaded portion 264 configured to match and engage with the internal threads 260 on the stabilizer 106. As shown in this section of the coring tool 100, encased within the outer barrel 262 is the outer tube 163, the inner tube 126 and insulative sleeve 206. Disposed on and attached to the outside surface 266 of the sleeve 206 is an inner tube lifting sleeve 268 which includes a lip or upset 270. As will be further described with reference to FIG. 2D, this upset 270 is positioned at a location relative to the inner tube 126 such that the upset 270 will engage with a shoulder 281 of a seal sub 280 attached to the outer tube 163 after the inner tube 126 and a core sample contained therein has cleared the ball valve 160 illustrated in FIG. 2A. Thus, once the sleeve 268 engages with the outer tube 163, continued lifting of the inner tube 126 will result in lifting of the outer tube 163 and structure attached thereto such as the ball valve 160. In addition, because at this point the ball valve 160 will preferably be in a closed position, the core sample is now being lifted at in situ pressure. The sleeve 268 is also provided with annular grooves 272 and 274 on its outer surface 276 to provide a sealing surface thereon. O-rings or polypak seals may be inserted into the annular grooves 272 and 274 for providing seals when the outer surface 276 contacts the upper seal sub 280 illustrated in FIG. 2D.

Figure 2D:
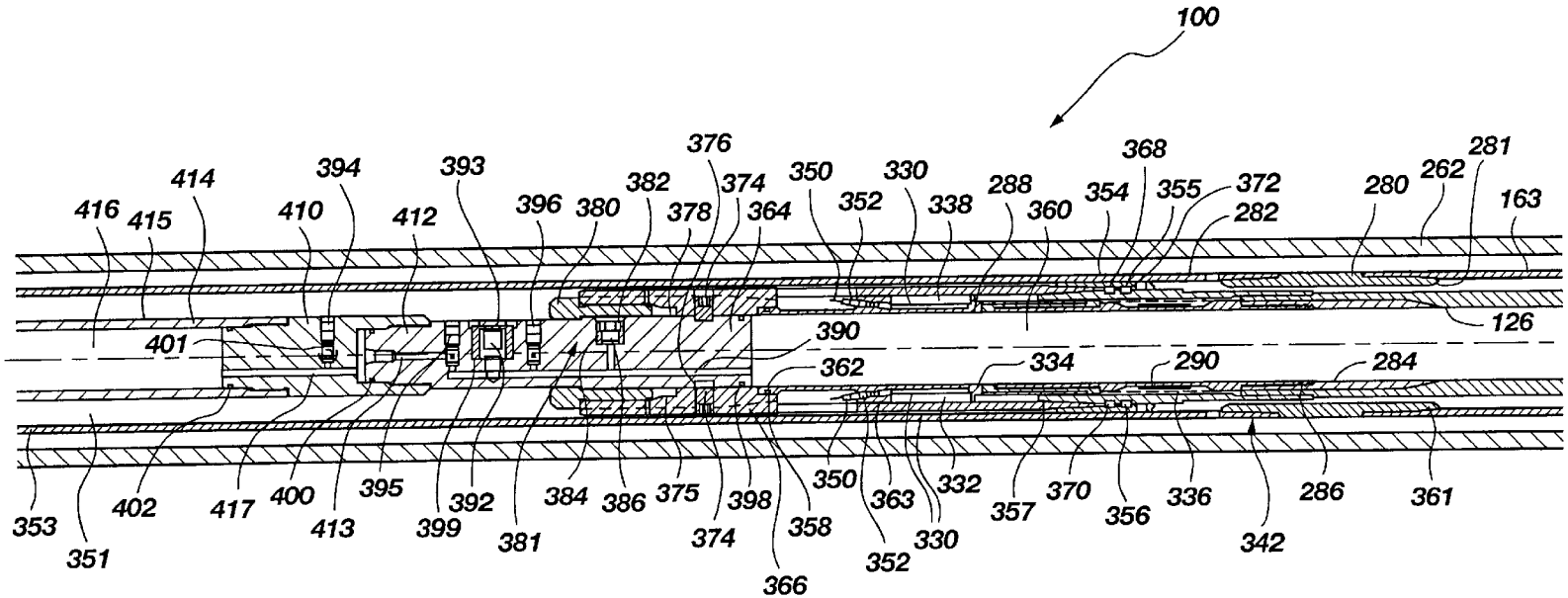

In FIG. 2D, the outer barrel 262 shown in FIG. 2C houses the upper seal sub 280 which is preferably threadedly engaged with and joined to and between the lower outer tube 163 and the middle outer tube section 282. Likewise, an inner seal member 284 having o-ring 286 seals the inner tube 126 to the thermal electric cooling (TEC) system assembly, generally indicated at 288. The TEC system 288 is employed to substantially maintain the temperature of the core while it is in transit from the bottom of the borehole to the surface and thus help prevent degradation of the core sample during the tripping operation. Preferably, the inner tube 126 is comprised of a thermally conductive material such as aluminum or another metal or a metal alloy, and is connected to a series of thermal electric coolers 290. These coolers 290 are preferably powered by a rechargeable battery pack located higher up in the tool.

Figure 3A:
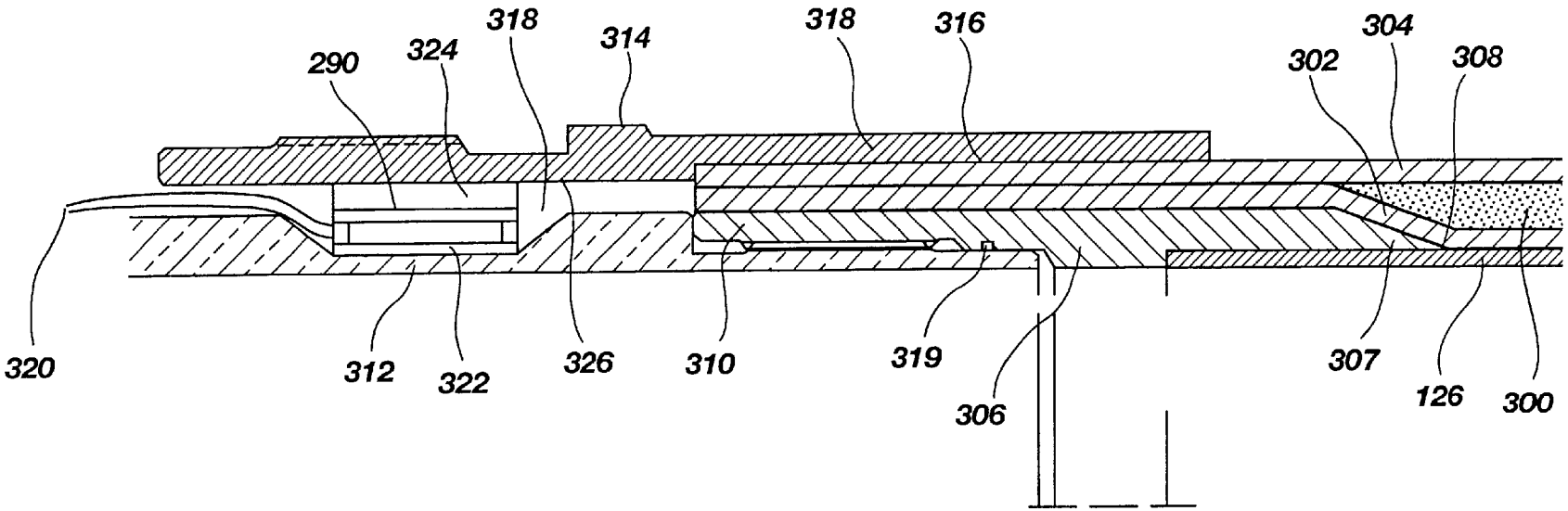
FIG. 3A is a partial cross-sectional side view of a first preferred embodiment of an insulated and cooled inner tube in accordance with the present invention.

As shown in more detail in FIG. 3A, the inner tube 126 is provided with insulation 300 surrounded by filament wound composite layers 302 and 304 to prevent hydrostatic pressure from collapsing the insulation 300. Preferably, the insulation is comprised of a foam material. It is also contemplated that the layers 302 and 304 may be comprised of metal and that the insulation 300 may be omitted such that the mere existence of a space such as an evacuated chamber defined between the layers 302 and 304 provides sufficient insulation just as an insulation effect is achieved with a Thermos® bottle.

An interface sleeve 306 is attached at its distal end 307 to the inner tube 126 as with a TIG weld 308. The proximal end 310 of the interface sleeve 306 is attached to a TEC carrier or holder 312. The TEC holder 312 is preferably comprised of beryllium copper and is faceted for securing the thermoelectric cooling elements 290 thereto. A TEC cover 314 is attached to the outside surface 316 as with a structural bond 318. The steel cover 314 in combination with the TEC holder 312 provides a protected chamber 318 for housing the TEC elements and their associated electronics. The TEC holder 312 is preferably threadedly connected to the interface sleeve 306. In addition, the interface sleeve 306 may include an annular groove 319 for housing an o-ring to seal the interface sleeve 306 to the TEC holder. Wires 320 extend from the TEC elements 290 to the TEC control electronics and battery supply, described in more detail below.

Preferably, the TECs 290 consist of several solid state devices which utilize the Peltier effect of transistors, i.e., electrical current through a transistor to create a temperature difference across the transistor. The TEC's 290, such as that manufactured by Melcor Corp., cold side 322 is preferably mounted to the holder 312 using a copper-filled or aluminum oxide epoxy for high conductivity. In addition, precision machined copper blocks 324 are mounted, with the same adhesive, to the hot side of each TEC 290. These blocks 324 preferably match the curvature of the sleeve 314 enclosing the TECs 290 and thus fit closely against the inside surface 326 so that thermally conductive grease positioned between the blocks 324 and the sleeve 314 create a thermal path to the outer tube.

Figure 3B:
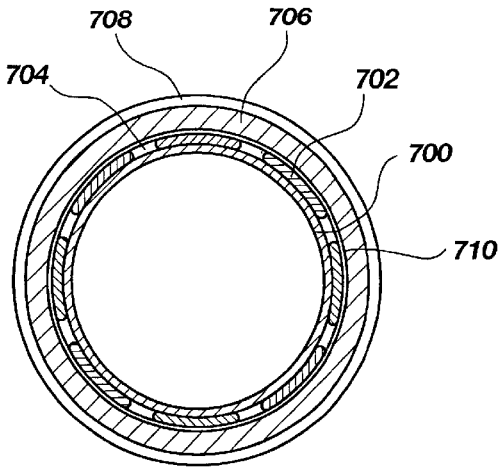
FIG. 3B is a cross-sectional view of a second preferred embodiment of an insulated and cooled inner tube in accordance with the present invention.

In another preferred embodiment illustrated in FIG. 3B, the inner tube 700 is comprised of steel and is surrounded by a plurality of heat pipes 702. The heat pipes 702 are mounted directly to the inner tube 700 with an adhesive 704 such as an epoxy. Preferably, the core catcher connecting threads (see FIG. 2A) are machined directly into the inner tube 700 eliminating at least one component from the embodiment described in FIG. 2A. Similarly, the upper end may include a threaded connection integrated into the inner tube 700. The heat pipes 702 are surrounded by a foam layer 706 covered by an outer shell 708 preferably comprised of a filament wound epoxy filled carbon. To ensure adequate transfer of thrust loads imposed by captured pressure within the inner tube 700, the heat pipes 702 may be shortened such that they do not extend over the threaded connection. As such, an adequate safety factor in the bonding between the outer composite layer and the rest of the inner tube 700 is provided. Moreover, the adhesive is selected to have a high shear strength for safe load transfer. It may also be desirable to provide a thin carbon fiber and epoxy composite layer 710, or some other high tensile strength layer, between the heat pipes 702 and the foam layer 706 to protect the heat pipes from compressive loads that may otherwise be imposed on the heat pipes due to external (hydrostatic) pressure. Such a layer 710 may lower stresses on the relatively weak heat pipes, which are preferably comprised of copper, and keep them from collapsing. While the illustration in FIG. 3B, shows the heat pipes 702 being contoured to fit about the inner tube 700, the contoured heat pipes 702 may be replaced with a larger number of more circularly configured heat pipes of smaller cross-sectional size.

Figure 3C:
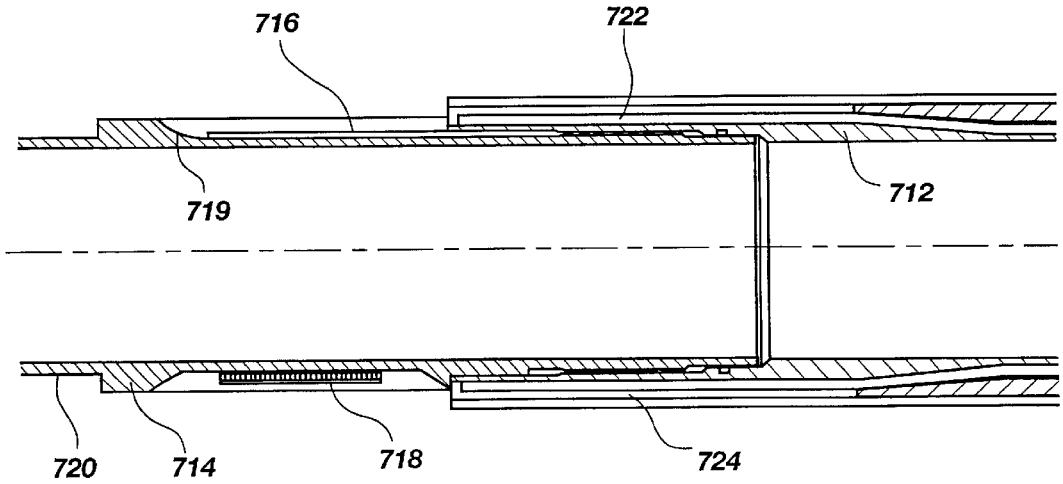
FIG. 3C is a cross-sectional side view of a third preferred embodiment of an insulated and cooled inner tube in accordance with the present invention.

As shown in FIG. 3C, to maximize heat transfer across the threaded connection between the inner tube 712 and the TEC carrier 714, heat pipes 716 are incorporated into the TEC carrier 714. The heat pipes 716 extend from the shoulder 719 at the threaded end 720 to the distal end of the TECs 718. As illustrated, the heat pipes 722 are mounted in the carrier wall to minimize the distance heat must flow from the heat pipes 722 to the TECs 718. In addition the composite inner tube 724 is attached to the TEC carrier 714 such that the heat pipes 722 extend over the TEC heat pipes 716 resulting in an efficient means of carrying heat from the inner tube 724 to the TEC carrier 714. Preferably, the heat pipes will be partially evacuated and filled with a coolant such as a methanol chloride solution. The coolant is circulated through the heat pipes 722 by evaporation and condensation that will occur within the heat pipes 722 as various portions of each heat pipe are exposed to different temperatures. It is also contemplated that the coolant could be circulated using mechanical means such as a pump. A wicking material may also be included which is comprised of copper mesh. The heat pipes 722 preferably operate over a temperature range of −10 to 30 degrees centigrade.

Referring again to FIG. 2D, electronics, collectively referenced at 330, to control the function of the TECs 290 are placed adjacent to the TEC elements 290 within a pressure tight chamber 332. The electronics carrier 334 also forms a part of the inner tube 126.

Preferably, the temperature control system 288 consists of current regulators, switches for the coolers, a comparator, a temperature sensor, and a means for setting the temperature at any of a number of different temperatures. These components may be mounted on one or more printed circuit boards and housed in the same chamber 336 as the TECs 290 and/or in the electronics chamber 338. The TECs 290 may be switched on/off to regulate the temperature that is selected on a multi-position switch.

Wires or cables 350 connected through the high pressure bulkhead connectors 352 carry the power from a battery pack (as will be described in more detail) to the TECs 290. Preferably, the cables 350 comprise molded cable assemblies to ensure reliability. The cables 350 travel along the space 351 defined between the outer tube section 353 and the pressure barrel 414. Preferably, the cables 350 are secured to the outside surface 415 of the pressure barrel with bands or other retaining mechanisms or structures. As with other components described herein, o-rings 354, 355, 356, 357, 358, 361 and 363 are provided to seal the various components of the cooling system 288 to produce a sealed core retrieval chamber 360.

At the proximal end 362 of the cooling system 288, a sealing device or member such as an inner tube plug 364 is secured thereto to form the proximal end of the chamber 360. The plug 364 is secured to the proximal end 362 of the electronics carrier 334 with a sleeve 366 which extends over the TECs 290 and is coupled to the inner tube 126 with coupling 368 and split rings 370 and 372. The plug 364 is secured to the sleeve 366 by a plurality of pins 374 which are preferably threadedly engaged into a plurality of holes 376 provided in the outer surface 378 of the plug 364. Because the plug 364 is made to be removable from the inner tube 126, as is desired to remove a pressurized core from the chamber 360 when the inner barrel 48 is retrieved to the surface, the pins 374 may be unscrewed to a point where the distal end of the pin 374 no longer engages with the hole 376 in the plug 364. When each pin 374 is sufficiently disengaged, the plug 364 may be removed from the inner tube 126.

In addition, because the chamber 360 may be under high pressure when the pins 374 are removed, a safety nut 380 which is threadedly engaged with the sleeve 366 retains the plug 364 relative to the sleeve 366 as the pins 374 are removed or at least partially extracted. The plug 364 is also provided with a burst disk assembly, generally indicated at 381, comprising a burst disk holder 382, a burst disk ring 384, and a burst disk 386. The burst disk assembly 381 is in communication with a passageway 390 which is in fluid communication with the chamber 360. The passageway 390 may be comprised of an internal bore extending from the distal end of the plug 364 to various pressure sensors and valves. For example, a pressure transducer 392 having a pressure cap 393 is in fluid communication with the passageway 390 to measure the pressure within the chamber 360. The pressure transducer 392 may provide pressure data during the drilling operation, as the core is being tripped to the surface, and when the inner barrel 342 is at the surface. Accordingly, constant pressure monitoring can occur to ensure that the inner barrel 342 does not become pressurized over a maximum internal pressure. In addition, several valves 394 and 396, such as valves commonly referred to as bullet valves, are positioned within the plug 364 and in communication with the passageway 390 such that the pressure within the chamber 360 can be controlled. For example, by attaching one or more of the valves 394 and 396 to a pressure source, the pressure within the chamber 360 can be increased. Likewise, by opening one or more of the valves 394 and 396, the pressure within the chamber 360 may be decreased or fluid samples obtained.

Of course, the various pressure components should be sealed relative to the chamber 360 so that they maintain a relatively constant pressure within the chamber 360. Such sealing may be accomplished with o-rings 398, 399, and 400, gaskets, or other sealing structures and members known in the art.

The burst disk 381 is incorporated into the pressure section to protect the equipment and operators from possible over-pressure and resulting bursting of the inner barrel 342. The burst disk assembly 381 is calibrated quite accurately to release the pressure from the chamber 360 preferably at a pressure of 4000 psi. A pressure tolerance of 4000 psi allows for slight over pressure of the inner barrel 342 during core transfer, etc. without bursting and still falls well within the safe design range of the inner barrel assembly 342.

An accumulator end sub 410 is attached to the proximal end 412 of the plug 364 and sealed thereto with o-ring 400. The sub 410 includes a bullet valve 394 which is sealed to the sub 410 with o-ring 401. The valve 394 is provided in communication with the passageway 417 extending through the sub 410. The sub 410 is attached to the accumulator barrel 414 and sealed thereto with o-ring 402. Preferably, the pressure barrel 414 defines a pressure chamber 416 which is typically pressurized to a pressure that will predictably be at least as high as the in situ pressure experienced downhole. The valve 394 is utilized to bleed off pressurized gas from within the chamber 360 when disassembling the pressure barrel 414 from the plug 364. In addition, pressurized fluid within the chamber 360 can be bled off or sampled by opening the valve 396, which is normally in a closed position when downhole. The pressure within the pressure chamber 416 is equalized with the pressure in chamber 360 by opening the valve 395 which will allow liquid and/or gas within the chamber 360 to flow through the passageways 390, 413 and 417 to the pressure chamber 416.

The purpose of the pressure section is to first, provide some measure of protection from rapid pressure fluctuations due to thermal changes and/or slow leakage. Second, the pressure section provides for safe release of pressure in the unlikely event that the barrel traps pressure downhole or produces pressures above specified allowables. The pressure section also contains a pressure transducer to check the system pressure after the barrel is brought to the surface. In addition, the pressure control section is equipped with externally operable shut-off valves, such as valve 394, and access ports to allow for isolating the two sections and for bleeding off pressure before disconnecting them. These same access ports also provide for sampling core fluids if desired.

Figure 2E:
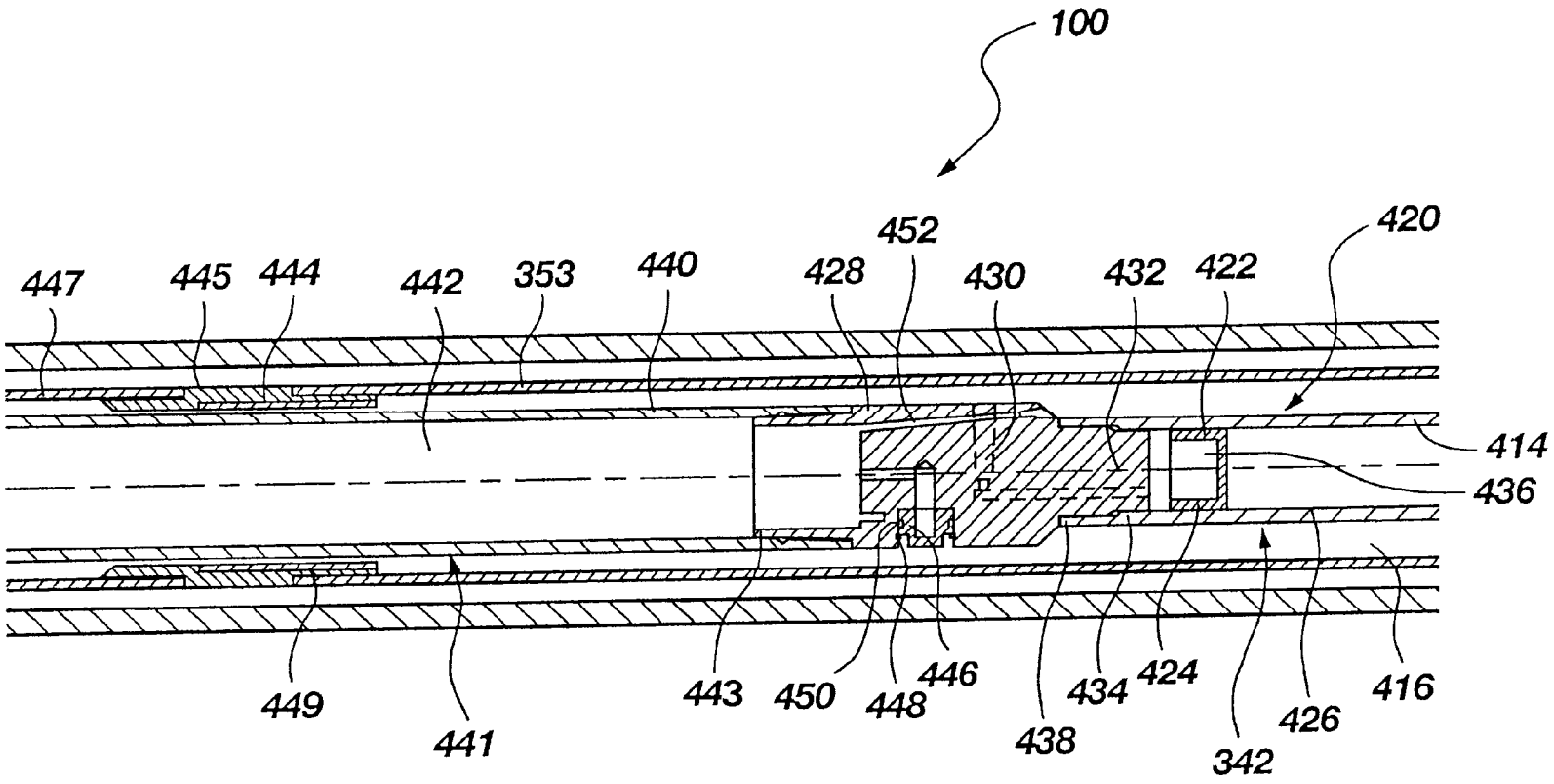

Referring now to FIG. 2E, a gas accumulator generally referred to at 420, is incorporated into the coring tool 100. The gas accumulator 420 includes a piston 422 slidable within the pressure chamber 416. An o-ring groove 424 is provided to house an o-ring for sealing the piston 422 to the inside surface 426 of the pressure barrel 414. The piston 422 also separates pressurized gas contained between an accumulator fill sub 428 and core fluids contained in the pressure chamber 416. The accumulator fill sub 428 includes a valve 430 in communication with a passageway extending from the valve 430 to the distal end 432 of the fill sub 428. The distal end 432 of the fill sub 428 is sealed to the pressure barrel 414 with an o-ring 434. The accumulator fill sub 428 is also provided with a passageway or exit port 452 through which the cable 350 shown in FIG. 2D may connect to a battery pack 442. In operation, the chamber 436 is charged with a high pressure gas, such as nitrogen, prior to the tool 100 running in the hole. Preferably, the charge is about half of the expected bottom hole pressure, but may be adjusted for different pressure/leakage characteristics if desired. As the tool 100 is lowered into the hole, the increasing bottom hole pressure forces the piston 422 toward the proximal end 438 of the pressure barrel 414 compressing the gas until equilibrium is reached. Preferably, this equilibrium is such that as the barrel 414 reaches the borehole bottom, the chamber 436 is approximately equal in size to the size of the pressure chamber 416 and thus the piston 422 is positioned approximately half way between the fill sub 428 and the accumulator end sub 410.

As previously described, the ball valve 160 shown in FIG. 2A is preferably closed to seal the core sample at bottom hole or in situ pressure. As the core sample is brought to the surface, any leakage or volume changes due to temperature or pressure variations may be partially compensated for by the pressurized gas in the chamber 436. After viewing the present invention, those skilled in the art will appreciate that the pressure response of the system is proportional to the chamber volume and initial pressure and is therefore easily modeled. Preferably, the pressure chamber 436 is sized so that a leakage of 1 cu in. (16.4 ml) per minute therefrom for thirty minutes would result in a loss of only half of the pressure contained with in the pressure chamber 436. For methane hydrates, a loss of half of the pressure from the chamber 436 as described would still substantially preserve the integrity of the core sample as methane hydrates typically do not begin to decompose and give off large quantities of gas until pressures are reduced to approximately 500 psi (34 bar). Assuming that no significant leakage of the pressure chamber 436 occurs between coring runs, the chamber 436 typically should not have to be recharged between each coring run.

As further illustrated in FIG. 2E, a battery barrel 440 is attached to and sealed as with o-ring 443. The battery barrel 440 houses the battery pack 442 that provides electric power to the electronics 330 and the TECs 290 shown in FIG. 2D. The battery pack 442 preferably comprises a plurality of rechargeable cells with an external means of switching the batteries on and off. Preferably, the battery pack 442 can provide for one hour of continuous full power cooling.

Because the outer tube 353 moves with respect to the battery barrel 440 as the ball valve 160 (see FIG. 2A) is actuated, the battery barrel 440 is attached to a magnet sub 444, which trips a switch 446 that is attached to the accumulator fill sub 428 with retaining ring 448 and sealed thereto with o-ring 450. The magnet sub 444 is comprised of a coupling 445 which attaches the outer tube portion 353 to the outer barrel portion 447 and a magnet 449 attached thereto facing the battery barrel 440. This magnetic sensing switch, commonly referred to as a Hall effect sensor, turns on the power to the electronics 288 (see FIG. 2D) as the ball valve 160 (see FIG. 2A) is closed prior to the inner barrel, generally indicated at 342, being tripped to the surface. For example, during the ball valve 160 closure process, the Hall effect sensor 446 in the sub 428 positioned just below the battery pack 442 moves into the magnet sub 444 and thus magnetically trips the Hall effect switch 446. Of course, those skilled in the art will appreciate after reviewing the present invention that other switching devices and mechanisms whether electronic or mechanical or a combination thereof may be employed to selectively activate the battery pack 442.

The use of a Hall effect switch 446 and other electronics may draw power from the battery pack 442 at all times. Thus, it may be desirable to employ other types of switching mechanisms that would further limit the power draw on the battery pack 442 when the batteries are not being utilized to provide power to the TECs 290. In addition, it may be desirable to remove the battery pack 442 from the battery barrel tool 100 during extended periods of storage or to exchange it quickly with a fully recharged battery pack 442.

Figure 2F:
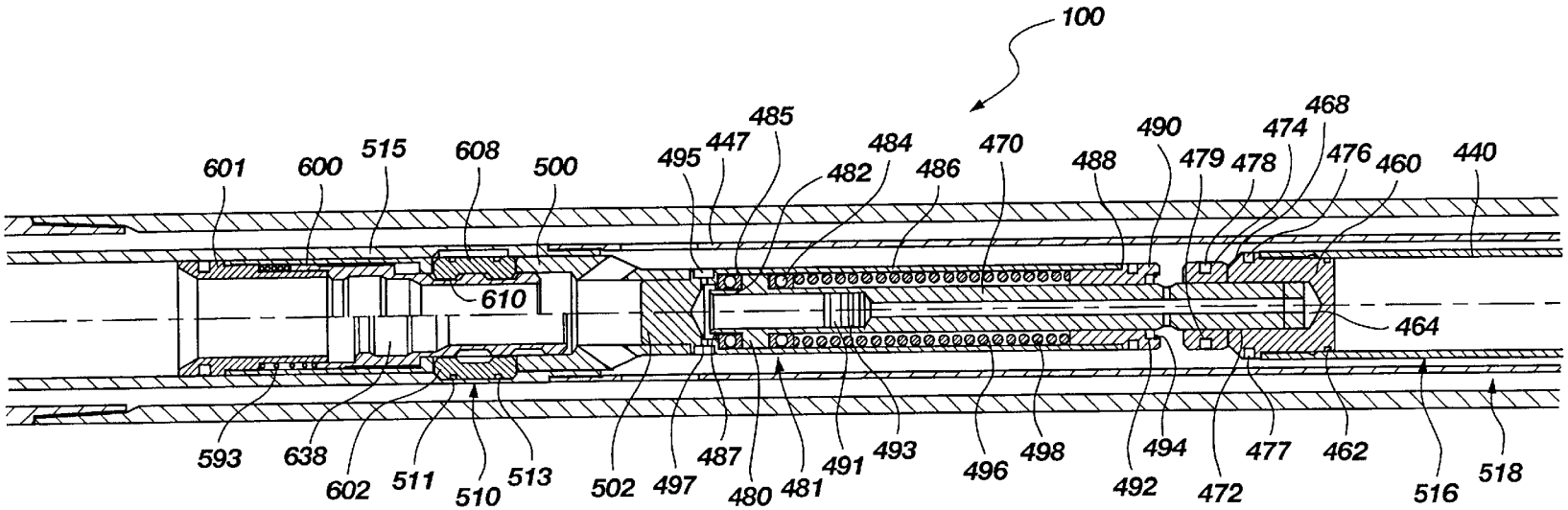

As further illustrated in FIG. 2F, the battery barrel 440 is attached to a battery end cap 460 and sealed thereto with o-ring 462. Because it is desirable to allow adjustment of the core shoe 144 (see FIG. 2A) relative to the bit 102, the battery end cap 460 is provided with a threaded bore 464 at its proximal end 468 for adjusting the inner tube, and thus the core catcher relative to the outer tube. An elongate shaft or bearing mandrel 470 having an externally threaded portion 472 is secured to the end cap 460. In addition, a bearing locknut 474 is threaded onto the mandrel 470 and abutted against the end cap 460 to ensure that the mandrel 470 does not easily unscrew from the end cap 460. In order to tighten the end cap 460 relative to the locknut 474, each are provided with keyways or bores 476–479 to which tools (not shown) may be attached to rotate the components relative to one another.

The mandrel 470 is provided with at least one transversely extending protrusion or retaining portion 480 proximate its proximal end 482. Bearings 484 and 485 are secured about the retaining portion 480 to allow the proximal end 482 of the mandrel 470 to slide relative to the bearing housing 486. The bearing 485 is held relative to the retaining portion 480 with a retaining ring 487 which abuts the bearing 485 and is secured within an annular groove provided in the mandrel 470. The bearing housing 486 extends along a substantial length of the mandrel 470 and is secured relative thereto at the distal end 488 of the bearing housing 486 with a bearing seal sub 490. An oil seal 492 which is held relative to the bearing seal sub 490 with a retaining ring 494 helps prevent oil, grease, or other lubricants contained within the bearing housing 486 from escaping as the mandrel 470 actuates. A grease fitting 495 and pipe plug are provided to supply lubricants to the bearing and mandrel assembly. In the space 496 defined between the mandrel 470 and the bearing housing 486, a biasing device, such as a coil spring 498 is positioned to force the bearing 484 from the seal bearing 490. Thus, the mandrel 470 is biased relative to the ball valve latch housing 500.

Compensating piston 491 and associated sealing member 493 provides pressure balancing of the oil or grease contained within the bearing housing 486, with the mud pressure external to the oil seal 492. This pressure balancing extends the life of the oil seal 492, reduces friction associated with the rotating oil seal 492, and reduces the tendency of the inner tube to rotate with the outer tube and outer barrel.

In addition to longitudinal movement of the lower inner barrel assemblies 518 relative to the latching mechanisms at the upper portion of the tool 100, the mandrel 470 while being fixed relative to the battery end cap, is free to rotate relative to the bearing housing 486. Accordingly, the bearing housing 486 and mandrel 470 assembly provides a swivelling mechanism, generally indicated at 481, which allows the inner barrel 518 of the coring tool 100 to stay relatively stationary as the outer barrel 262 rotates to rotate the coring bit 102 into the formation.

A swivel mechanism 481 provides for free rotation of the outer barrel 262 relative to the inner tube 126 so that the inner tube and core catchers 120 do not rotate and damage the core. The swivel mechanism also provides a low friction connection for both axial and radial loads. In the axial direction, the swivel mechanism 481 provides free rotation in the case of either up or down thrust of the inner tube 126.

Normally the inner tube 126 hangs from the swivel mechanism 481. However, it is possible for the inner tube 126 to develop upward thrust should the core have difficulty entering the core catcher or become jammed in the inner tube 126. Core jamming can produce axial forces on the swivel mechanism 481 equal to the applied weight on bit and is the usual cause of swivel mechanism 481 failure. In the radial direction, the swivel mechanism 481 prevents the top end of the inner tube 126 from rotating against the outer tube 353. This is especially true in high angle holes. The swivel mechanism is located just below the ball valve latch assembly 510. The bottom of the inner tube 126 is guided radially by an ultra-high molecular weight polyurethane journal bearing installed in the ball valve end sub 160, which provides a low friction bearing for the lower end of the inner barrel assembly 518. This material is highly abrasion resistant and provides an extremely low coefficient of friction. Area for mud flow between the outer tube 353 of the inner barrel assembly 518 and bit is provided for by axial grooves or scallops in the inner diameter of the coring bit 102.

The oil sealed thrust bearings 485 and 484 (one for up thrust and one for down thrust) are incorporated into the swivel mechanism 481. The ball valve protection spring 498 is also contained in the swivel mechanism to better protect it from axial loads. The spring 498 is preloaded sufficiently to provide enough force to lift the battery section 441, pressure section 342 and inner tube 126 with the core in addition to closing the ball valve 160.

The biasing feature of the mandrel 470 and spring 498 arrangement is primarily provided to prevent overpull or damage to the ball valve components 160 shown in FIG. 2A, such as when full wireline pull is placed on the ball valve links 172 and link pins 190, as may be the case if the ball valve 160 jams in a fully or partially open condition or if the ball valve operator 184 does not reach the stop shoulder, resulting for example from a piece of the core protruding out the inner tube and core catchers. The ball valve mechanism 160 is thus protected by the ball valve protection spring 498 which is preferably part of the swivel mechanism 481 located between the latch section and the battery section 441. Locating the spring 498 above the inner tube 126 as previously discussed requires that it be strong enough to lift all of the weight of the battery section 441, pressure section 342, core, and inner tube assembly, generally indicated at 127, in addition to the desired controlled closing force.

Figure 2G:
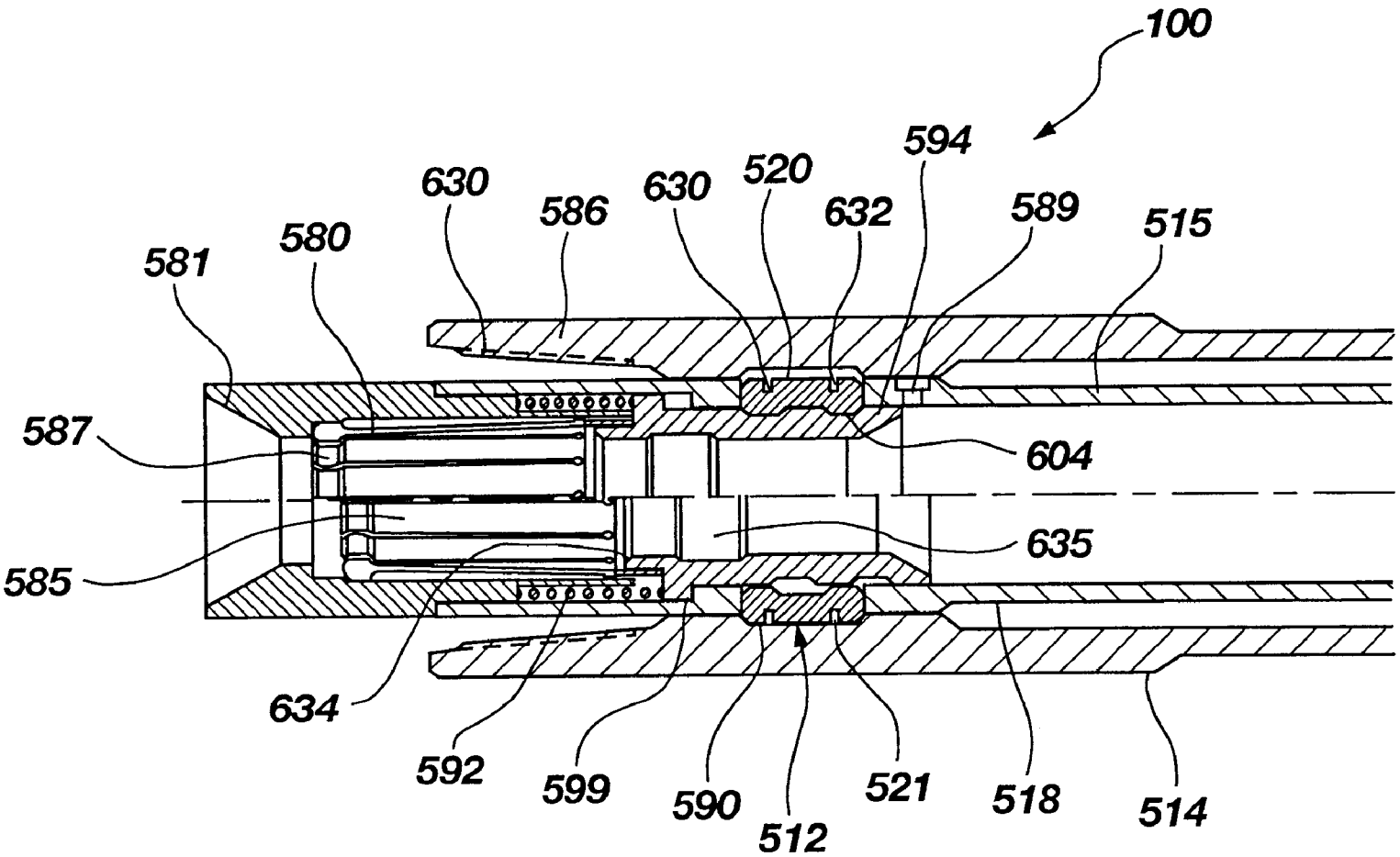

As further illustrated in FIGS. 2F and 2G, the proximal end 502 of the bearing housing 486 is preferably threadedly secured to the ball valve latch housing 500. The latching system illustrated in FIGS. 2F and 2G shows two positions of the latches, the lower half of the figures illustrating the position of the latches when the coring tool 100 is actively drilling into the formation and the upper half of the figures illustrating the position of the latches when the core sample is being retrieved while leaving the outer barrel and drill bit downhole.

As has been previously discussed, the coring tool 100 preferably employs a series of latches that work together to operate the coring tool 100 using a single wireline (not shown). Two latch assemblies 510 and 512 are provided to operate the coring tool 100. Thus, upper inner barrel latch locks or latch dogs 512 secure the inner barrel assembly 518 to the outer barrel assembly 514 while the coring operation is in progress and must be released to allow the inner barrel assembly 518 to come out of the hole while leaving the outer barrel assembly 514 downhole. The lower ball valve latch assembly 510 controls the operation of the ball valve 160 as previously described by allowing the inner tube assembly 516 to move relative to the outer tube assembly, generally indicated at 129. When the latch mechanisms 510 and 512 are in the position shown in the lower half of FIGS. 2F and 2G, the latch member 521 resides in a recess 590 provided in the inner surface of the landing sub 586. Likewise the latch member 511 mates with a recess 513 formed in the inner barrel latch housing 515. In this position, an inner barrel latch spring 592, which is retained between the inner barrel latch piston 594 and the inner barrel latch spring retainer 581, and a ball valve latch spring 593, which is retained between the ball valve latch piston 600 and a ball valve spring retainer 601, are in an expanded state with a portion 599 of the inner barrel latch piston 594 abutted against the inner barrel latch housing 515. Likewise, the ball valve latch piston 600 abuts against the ball valve latch housing 500. In this position, the latch member 521 is not engaged with the inner barrel latch piston 594, and the latch member 602 is not engaged with the ball valve latch piston 600.

Conversely, when the latch mechanisms 510 and 512 are in the position shown in the upper half of FIGS. 2F and 2G, the latch member 520 resides in a recess 604 provided in the piston 594 and the latch member 608 mates with recess 610 formed in the ball valve piston 600. In this position, the inner barrel latch spring 592 and the ball valve latch spring 593 are in a compressed state such that when the latch members 520 and 608 disengage from their respective pistons 594 and 600, the pistons 594 and 600 are forced to a position where the latch members 520 and 608 cannot mate therewith. In this position, the latch member 521 is not engaged with the landing sub 586 and the latch member 608 is not engaged with the inner barrel latch housing 515. Accordingly, the inner barrel assembly 518 can be recovered while leaving the outer barrel 514 and drill bit 102 downhole.

Figure 4A:
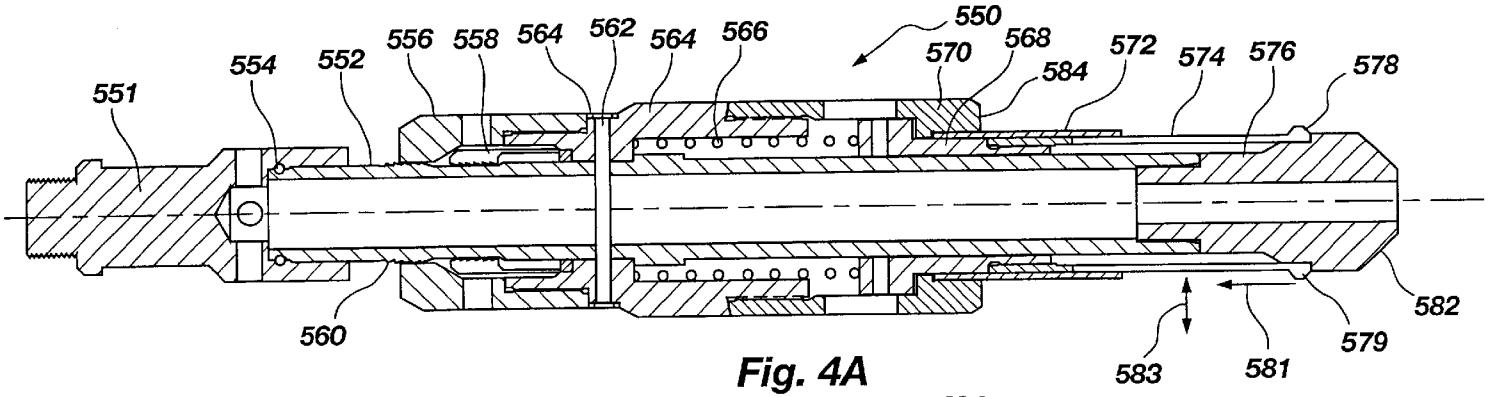
FIG. 4A is a preferred embodiment of a running tool in accordance with the present invention.
Figure 4B:
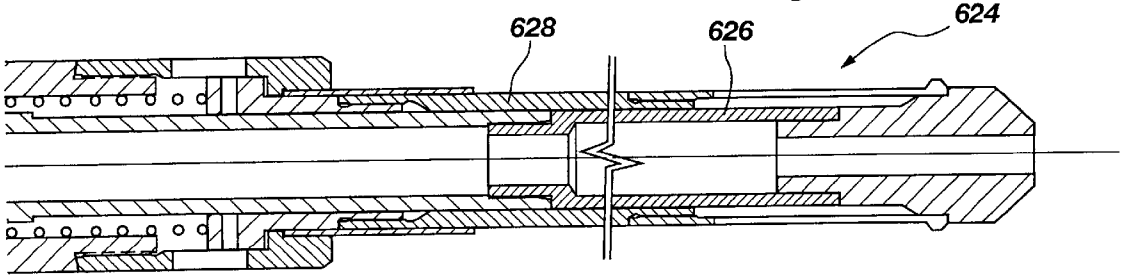
FIG. 4B is a preferred embodiment of an emergency release pulling tool in accordance with the present invention.
Figure 4C:
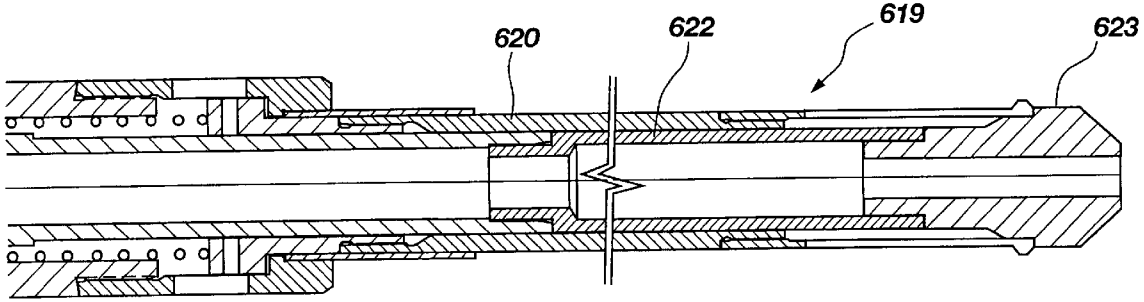
FIG. 4C is a preferred embodiment of a pulling tool in accordance with the present invention to be used in normal operations.

As shown in FIGS. 4A–4C, the system preferably utilizes modified Camco PRS pulling tools for setting and retrieving the inner barrel assembly 518. A running tool 550 is comprised of a fishing neck 551 attached to a mandrel 552 and having a shear pin 554 interposed thereinbetween. A ratcheting system is comprised of a ratchet housing 556 and a ratchet sleeve 558 positioned to engage with teeth 560 provided on the outside of the mandrel 552. A shear pin 562 retained by a shear pin sleeve 564 secures the mandrel 552 to the spring housing 564. The spring housing 564 contains a coil spring 566 which is interposed between the spring housing 564 and the collet base 568. The collet base 568 is secured relative to the mandrel 552 with a collet housing 570. The collet body 574 is secured to the collet base 568 and is partially housed by a housing extension 572. The collet body extends to the collet core 576 which is secured to the distal end of the mandrel 552. The collet body 574 is provided with a plurality of upsets such as upsets 578 and 579 to engage with an inner barrel latch collet 580 formed into the inner barrel latch spring retainer 581 shown in FIG. 2G. Thus, as shown by the arrows, when the running tool 550 is inserted into the inner barrel latch collet 580, the upsets 578 and 579 are forced away from the end portion 582 as indicated by the arrow 581 to a position where they can bend or flex as indicated by arrows 583. In addition, the collet 580 is comprised of a plurality of finger-like projections 585 having protrusions 587 thereon for grasping the upsets 578 and 579 to hold the collet body 574 relative to the tool 100 when the projections 585 are in the position shown in the upper half of FIG. 2G. The projections 585 expand to release the collet body 574 when in the position shown in the lower half of FIG. 2G. As such, prior to running the inner barrel 518 into the borehole, the inner barrel 518 may be hung from the running tool 550. Inserting a threaded bolt (not shown) into the threaded bore 589 prevents the piston 594 from moving to the position shown in the lower half of FIG. 2G. Such a bolt is removed prior to running the inner barrel 518 downhole. Thus, when the end portion 582 on the collet core 576 engages with the piston shoulder 634 formed into and defined by the inner barrel latch piston 594, the collet 580 moves to the position shown in the lower half of FIG. 2G, automatically releasing the running tool 550. As such, the latch members 520 and 521 engage the outer barrel 514. Accordingly, when the running tool 550 releases, the operator knows that the latches 520 and 521 have engaged and the tool 100 is ready for drilling.

The shear pins 554 and 562 are not used in normal operation but are provided in the case of failure of the latching system. Of course, those skilled in the art will appreciate after understanding the present invention that other drilling accessory equipment such as jars, weights, over shots, etc., along with a wireline unit will be employed with the present invention. The coring tool 100 is designed such that the spacing between the landing shoulder 584 and collet shoulder 582 effects the operation of the latches and thus the operation of the coring tool 100. For example, the running tool 550 illustrated in FIG. 4A is configured to engage with the inner barrel latch collet shown in FIG. 2G when the tool 100 reaches the bore hole bottom and thus while the tool 100 is being employed for drilling a core sample. Accordingly, the latches 520 and 521 are maintained in the position of that illustrated in the upper half of FIG. 2G with the retention members 630 and 632, such as garter springs (e.g. metal bands) or o-rings that circumscribe the latch members 520 and 521 and bias the latch members 520 and 521 into the recess 604 while the inner barrel 518 is being inserted into the outer barrel 514. Conversely, the latch members 602 and 608 are positioned as shown in the lower half of FIG. 2F prior to running the inner tube 518 into the bore hole. When the inner barrel 51 is fully inserted into the outer barrel 514, the inner barrel latch piston 594 is downwardly forced by the running tool 550 thus forcing the latch members 520 and 521 to seat into recess 590 so as to lock the inner barrel 518 relative to the outer barrel 514 as shown in the lower half of FIG. 2G. At this point, the running tool 550 will automatically disengage from the piston 594 and collet 580 and may be retrieved to the surface. When it is time to retrieve the core sample while leaving the outer barrel assembly 514 downhole, the long assembly pulling tool, generally referred to at 619, illustrated in FIG. 4C, which includes a long collet extension 620 and long mandrel extension 622, is employed. In other respects, the pulling tool 619 of FIG. 4C is essentially the same as that shown in FIG. 4A. The length of the pulling tool 619 in FIG. 4C is such that the pulling tool 619 will cause the ball valve to close and release the upper latch and also to allow tripping of the inner barrel assembly 518. If in a situation where the inner tube 518 becomes jammed, a medium length pulling assembly 624, as shown in FIG. 2B, which includes a medium collet extension 626 and a medium mandrel extension 628, may be employed that is not of sufficient length to close the ball valve 160 but will properly disengage the latching mechanisms so that the inner barrel 518 can still be retrieved while leaving the outer barrel 514 downhole. The inner barrel latch piston 594 is also provided with an emergency pulling tool recess 635 for grasping and retrieving the inner tube 518 without closing the ball valve 160. In addition, the pulling tool 619 may be provided with a smaller diameter end portion 623, to engage with a matching smaller recess 638, so as to provide a tool that will not pull tool 100 with the ball valve in an open position should the tool fail to latch properly. Thus, various profiles of pulling tools may be utilized, each providing a different engagement with the tool 100 for the desired operation. Accordingly, the same pulling tool may be used for all operations with only spacing tubes or extensions added or removed for the particular operation.

As shown in the upper half of FIG. 2G, the inner barrel latch 520 locks the inner barrel assembly 518 to the outer barrel assembly 514. Surface indication of proper operation of the latching mechanisms is provided through an automatic release of the running tool when the inner barrel assembly 518 lands on the shoulder 630 and the latch mechanism 512 correctly locks into position. The landing shoulder 630 locates the inner barrel assembly 518 in its proper relationship to the outer barrel assembly 514. The weight of the inner barrel assembly 518, the holding capability of the latch mechanisms 510 and 512 and pump pressure hold it in position during coring operations.

The ball valve latch 510 keeps the inner tube assembly 516 secured relative to the outer tube assembly, generally indicated at 129, to keep the ball valve 160 locked in the open position while running in the hole and during coring. Once coring is complete, the appropriate pulling tool is run to the tool 100 where it locks into recess 638 in the ball valve latch piston 600. The ball valve latch 510 is released by upward pull on a wireline. Continued upward pull on the wireline lifts the inner tube 126 and closes the ball valve 160, trapping the core at bottom hole pressure. In addition, completion of the required movement of the inner tube 126 to close the ball valve lifts the inner barrel latch piston 600, causing latches 602 and 608 to engage with recess 610, as shown in the upper half of FIG. 2F, as the latches 602 and 608 are inwardly biased by retention members 511 and 513, releasing the inner barrel assembly 518 from the outer barrel assembly 514. This allows the inner barrel assembly 518 to be brought to the surface.

Preferably, the inner tube latch 512 incorporates a second wireline tool recess 635 which can also be caught with a pulling tool adjusted for significantly shorter engagement. This feature allows the inner tube latch 512 to be caught and released and the inner barrel assembly 518 brought to the surface without closing the ball valve 160. The wireline tool may also feature a shear pin which activates an emergency release device allowing the wireline to be released in the case of a malfunction so that in a worst case, the drill string can be pulled without having to cut the wireline.

To break the core at the conclusion of the coring operation, a pull of approximately 10,000 pounds is applied to the core sample by lifting the drill string to break the core loose from the formation. In the case of sticking in the hole, a maximum pull of 600,000 pounds is allowable. Thus, after the core is severed, a pulling tool is lowered into the hole with a jar down assembly above it. The pulling tool drops into the ball valve latch 510 and is held in the recess 638 (see FIG. 2F) provided therein. When the pulling tool becomes properly engaged with the ball valve latch 510, a slight pull on the wireline will indicate whether such engagement has been properly achieved. If no resistance is detected, and continued attempts fail to engage the pulling tool with the ball valve latch 510, the wireline may be pulled up which will cause the pulling tool to latch into the inner barrel latch 520 and retrieve the inner tube assembly 516 without closing the ball valve 160. This will result in the core being retrieved in a non-pressurized state such that the core sample is subject to ambient pressures. In addition, it may be possible to jar down on the pulling tool allowing it to then pull freely through the inner barrel latch 520 without unlatching, returning it to the surface for refitting.

In normal operation with the pulling tool properly engaging the ball valve latch 510 to release the ball valve latch 510, pulling upwardly on the pulling tool approximately 17 in. to retrieve a core sample of similar length will then close the ball valve 160. Continued upward pulling of the wireline will then unlatch the upper, inner barrel latch 520 and allow the total inner barrel assembly 518 to trip to the surface with the ball valve 160 closed. In addition, when the assembly trips upward, the magnet 449 in the magnet sub 444 trip the Hall effect switch and activate the TECs.

If the ball valve 160 does not completely close, or for some reason the lower barrel is jammed not allowing full travel of the pulling tool, then the inner barrel latch 520 will not be opened. In this case, the pulling tool would be stuck. If this happens, jarring downward will release the pulling tool for retrieval to the surface. An emergency release tool may then be installed on the wireline and lowered back through the drill string. The emergency release tool is configured to latch into the inner barrel latch 520. Upward pulling of the wireline will release the inner barrel latch 520 and allow the full inner assembly to trip to the surface.

Figure 5A:
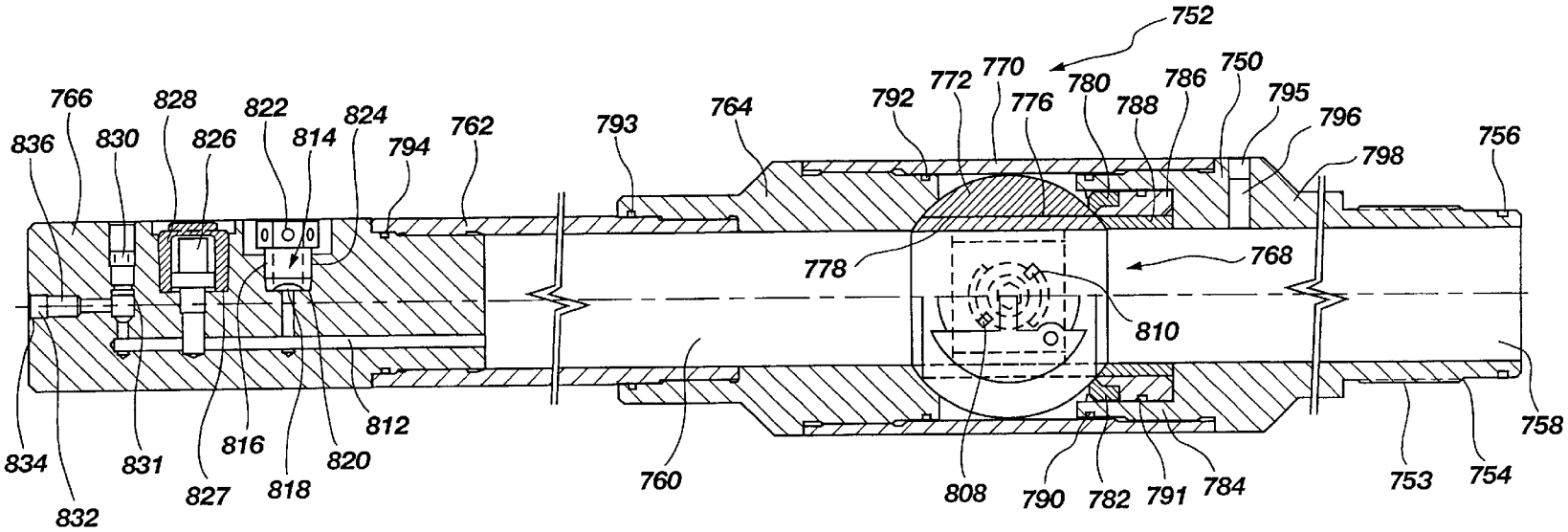
FIG. 5A is a cross-sectional side view of a first preferred embodiment of a transport container in accordance with the present invention.

Referring now to FIG. 5A, when it is desirable to transfer the core, the safety nut 380 shown in FIG. 2D on the proximal end of the core receiving chamber 360 is removed and a transport adaptor 750 which has external threads 753 along a distal portion 754 thereof is attached to a transport container, generally indicated at 752. The transport container 752 is attached to the proximal end of the core receiving chamber 360 by threading the transport adaptor 750 into the sleeve 366 (see FIG. 2D) which forms the proximal end of the inner tube 126. A seal 756 in the adaptor 750 engages a seal surface 375 on the inside of the sleeve 366. The diameter of the longitudinal bore 758 is sized to match the diameter of the chamber 360 and the distal end 754 of the adaptor 750 is configured so that substantially no gap between the adaptor 750 and the sleeve 366 exists when the two are properly mounted together such that a relatively smooth and flush transition exists to provide a relatively smooth and flush surface for core transfer.

Figure 5B:
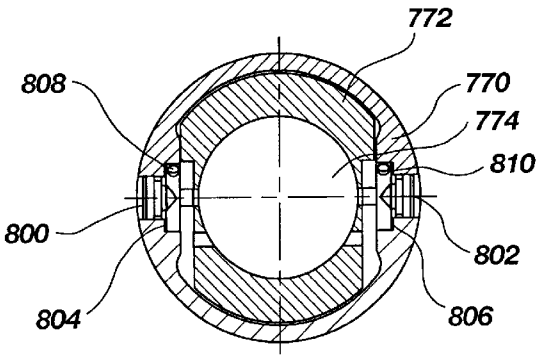
FIG. 5B is a cross-sectional view of the ball valve employed in the transport container illustrated in FIG. 5A.

As shown in FIGS. 5A and 5B, the transfer container 750 also includes a actuable sealing device or ball valve 160, generally indicated at 768, that is similar in configuration to the ball valve 160 shown in FIG. 2A. The ball valve 768 is comprised of a transport ball valve housing 770 configured to contain a ball 772. The ball 772 has an internal bore 774 therein defined by a ball liner 776 that is attached to the inside surface 778 of the ball 772. The diameter defined by the liner 776 is substantially the same as the diameter of the chamber 760 such that a core being transferred to the transport container 752 can relatively easily slide through the ball valve assembly 768. Similar in configuration to the ball valve assembly 160 illustrated in FIGS. 2A and 2B, the ball 772 is sealed relative to the adaptor 750 with a ball valve seal 780 which is held in place with a ball valve seal retainer 782 secured to the proximal end 784 of the adaptor 750 and a ball valve seat 786. A transport seal liner 788 is provided on the inside of the seat 786 to provide an internal diameter that substantially matches the internal diameter of the chamber 760. O-rings 790, 791, 792, 793, and 794 are provided to seal the various components together to provide a substantially pressure tight chamber 760.

Once the adaptor 750 is properly attached to the sleeve 366, the pressure inside the transport chamber 760 defined by a transport tube 762, a ball valve sub 764, and an end plug 766 is equalized to the pressure inside the core chamber 360 (see FIG. 2D). The assembly then is checked for leaks to ensure that the transport container 752 is properly mounted to and can sustain the pressure of the core chamber 360. The release pins 374 of the transfer plug 364 are then unscrewed to allow removal of the plug 364 from the sleeve 366. The core sample and transfer plug 364 can then be forced into the transport container 752 until the distal end of the core sample clears the ball 772 of the ball valve 768. The ball 772 is then manually closed by engaging and rotating the pivot pins 800 and 802 which, along with thrust washers 804 and 806 mount the ball 772 to the housing 770. Dowel pins 808 and 810 are provided to prevent over rotation of the ball 772 relative to the ball valve housing 770.

As further illustrated in FIG. 5A, the end plug 766 is configured similarly to the transfer plug 364 of FIG. 2D in that it includes a longitudinal passageway 812 that is in communication with the chamber 760 such that pressure within the chamber 760 can be controlled and monitored. Accordingly, a burst disk assembly 814 comprised of a burst disk holder 816, a burst disk 818, and a burst disk ring 820 are each held in place with a burst disk hold down plug 822 within the chamber 824 provided in the end plug 766. Additionally, a pressure transducer 826 held in place with a transducer cap 828 and sealed to the plug 766 with o-ring 827 is provided to monitor pressure within the passageway 812 and thus the camber 760. Bullet valve 830 is also secured to the adaptor 766 and sealed thereto with o-ring 831 and provided such that pressure within the chamber 760 can be increased by securing a pressure source to port 836 and opening the bullet valve 830 or decreased by opening the bullet valve 830 to allow pressurized fluid to vent through port 836. A plug 832 nay be provided to seal the proximal end 834 of the port 836 which is in fluid communication with passageway 812.

Figure 6:
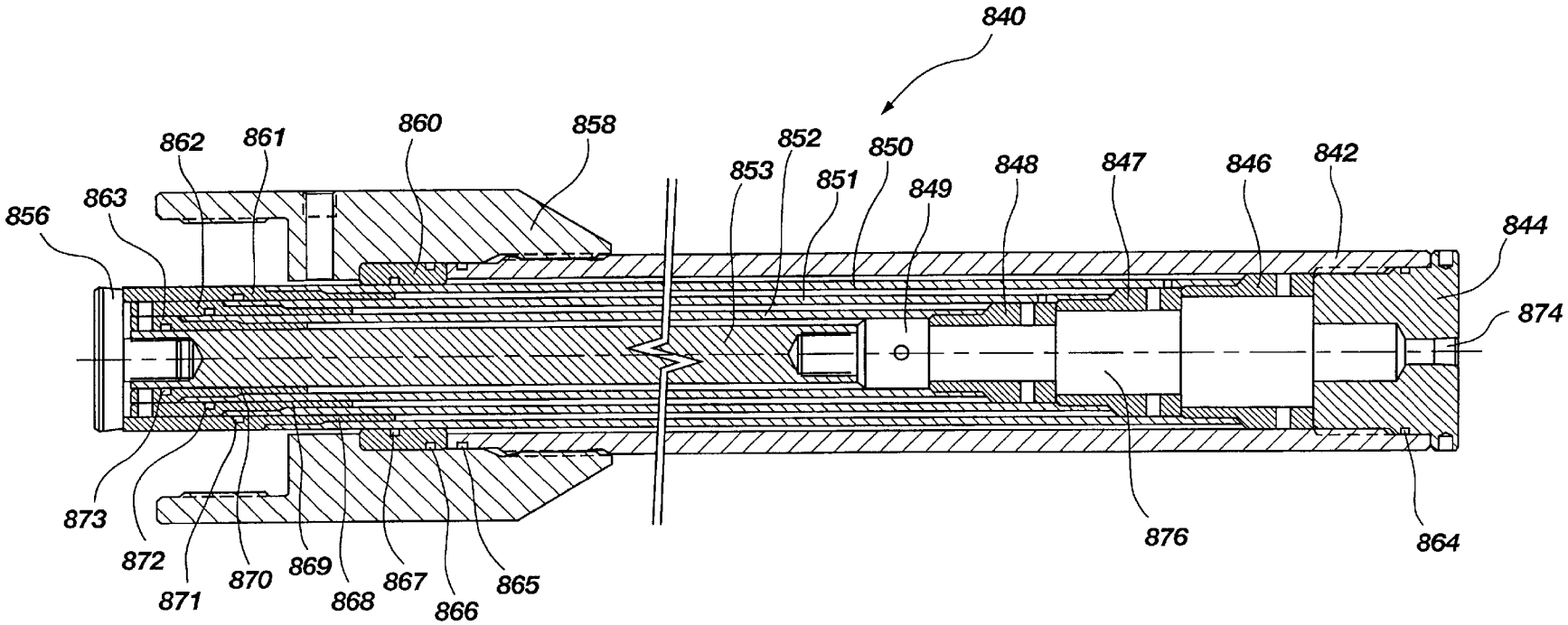
FIG. 6 is a cross-sectional side view of a preferred embodiment of a transferring device in accordance with the present invention.

As shown in FIG. 6, the core sample and plug 364 are preferably forced from the core sample chamber 360 by employing a hydraulic piston, generally indicated at 840, or some other transferring device. The hydraulic piston 840 is connected to the ball valve seal sub 210 (shown in FIG. 2A). The pressure below the ball 162 is equalized and the ball valve 160 opened with external keys. The hydraulic piston 840 is then charged to force the core into the transport container 752.

The hydraulic piston 840 is comprised of an outer housing 842 having an end cap 844 attached to a distal end thereof. A plurality of shaft bearings 846, 847, 848, and 849, in this embodiment four, are positioned within the housing 842, each having a smaller size than the previously adjacent bearing. A plurality of elongate members or shafts 850, 851, 852, and 853, are secured to a respective bearing 846–849 with each shaft 850–853 fitting within or about the other shafts, as the case may be. The innermost shaft 853 is secured to a piston cap 856. The proximal end of the hydraulic piston 840 is provided with an adaptor sub configured to mate with the sealing sub 210 as previously discussed. The outer housing 842 is attached to the sealing sub, as with a threaded connection, and a shaft guide 860, which acts as a bearing surface, is provided to guide the outermost shaft 850 relative thereto. Each shaft 850–852 is provided with a shaft end member 861–863, respectively. Additionally, each component is sealed relative to one another with o-rings 864–873. In operation, the shafts 850–853 define an extendable member by telescoping relative to one another such that when a hydraulic or other pressure source is provided and attached to the opening 874 in the end cap 844, the pressure source enters the chamber 876 defined by the shaft bearings 846–849 forcing the shafts 850–853 away from the end cap 844 and thus forcing the piston cap 856 into the core chamber 360. Moreover, the total extendable length of the telescoping shafts 850–853 is configured to be able to force the distal end of the core sample through the ball valve 768 of the transport container 752. Once the core sample has been successfully transferred into the transport container 752 and the ball valve 768 closed, the transport container 752 itself may be placed in a cooling device which will continue to maintain the integrity of the core sample during transport to a laboratory or storage facility.

Figure 7:
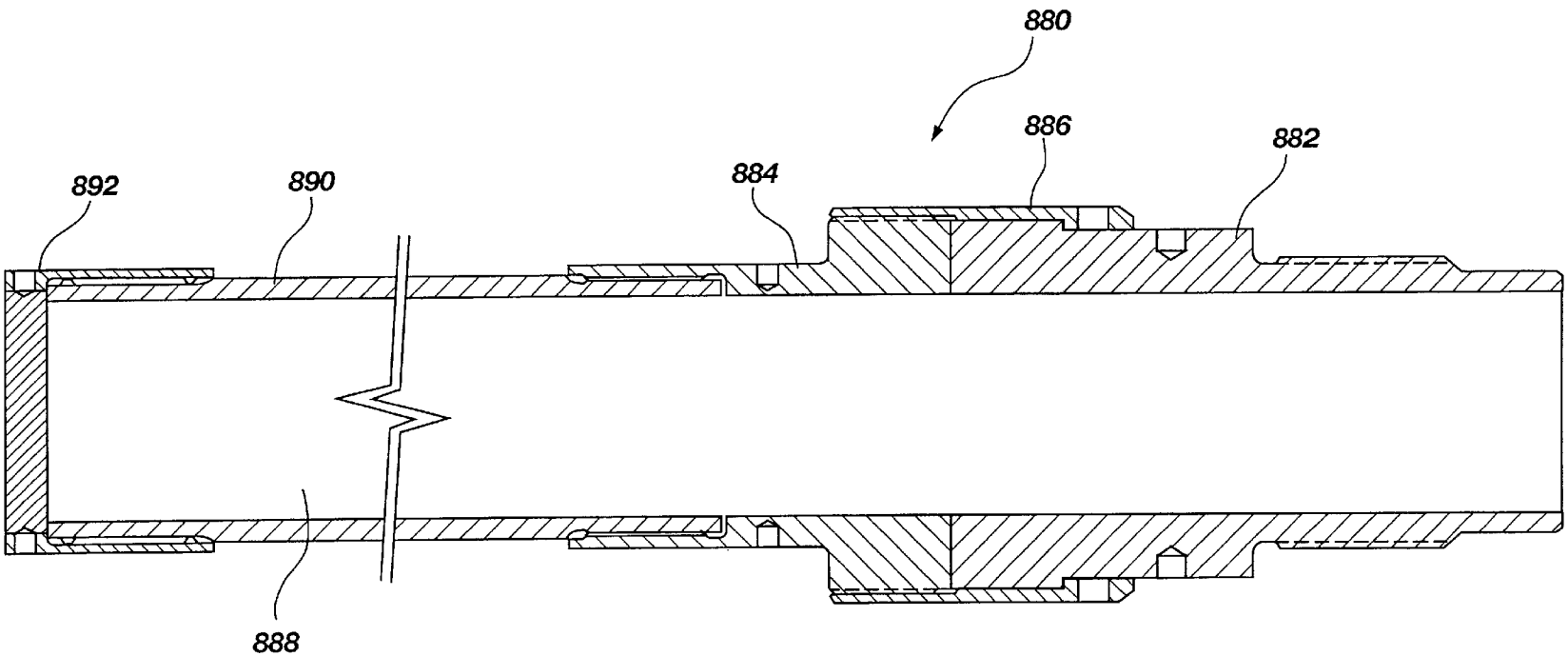
FIG. 7 is a cross-sectional side view of a second preferred embodiment of a transport container in accordance with the present invention.

In some instances, it may also be desirable to transport the core sample at ambient pressures. Accordingly, as illustrated in FIG. 7, a relatively simple split tube core receiver, generally indicated at 880, may be provided to house a core sample during transport. Such a core receiver may be comprised of, as illustrated in the present embodiment, a lock ring adaptor 882 configured to mate with the sleeve 366 shown in FIG. 2D. The lock ring adaptor 882 is attached to a split tube adaptor 884 with a coupling 886. The chamber 888 which will house the core sample is defined by a split tube 890. An end cap 892 defines the proximal end of the split tube core receiver 880. Even though when using the split tube core receiver 880, the core sample is not under in situ pressure, the hydraulic piston may still be employed to move the core sample from the core chamber 360 into the split tube core receiver 880. It is also contemplated that other devices for forcing the core from the chamber 360 may also be employed.

It is noted that because the preferred embodiment is generally a cylindrical device and because the various illustrated embodiments herein are shown in cross-section, often only a limited number of the components are visible. For example, while only two latching members 602 and 608 are shown in FIG. 2F, a plurality of such latching members may be circumferentially spaced at that location. A similar arrangement may be provided for the latch members 520 and 521 in FIG. 2G, components of the core catchers 120 in FIG. 4A, as well as others.

It will be readily appreciated that the components of the present invention, as generally described and illustrated in the figures herein, could be arranged and designed in a wide variety of different configurations including modifications to and combinations of the preferred embodiments. For example, although the embodiments described herein are particularly adapted for retrieving a core sample at in situ pressure while maintaining a temperature on the core sample, the various components herein described may be utilized on other coring tools where, for example, only in situ pressure is desired to be maintained. In addition, the preferred embodiments are only examples of preferred embodiments. Those skilled in the art after reviewing the present invention will appreciate that there may be other devices known in the art that could be used in place of or in combination with, or that could benefit from, the novel features described in the specific illustrated embodiments. Accordingly, the invention may be embodied in other specific forms without departing from its spirit or essential characteristics. The preferred embodiments are to be considered in all respects only as illustrative and not restrictive. The scope of the invention is, therefore, indicated by the appended claims, rather than by the foregoing description of the present embodiments. All changes which come within the meaning of range of equivalency of the claims are to be embraced within their scope.

What is claimed is:

1. An apparatus for transferring a core sample from a pressurized core retrieval chamber and for transporting the core sample, comprising:

a pressurizable core retrieval chamber configured for obtaining and maintaining a pressurized core sample;

a transport container having a distal end configured to mate with a proximal end of said pressurizable core retrieval chamber, said transport container defining a core sample transport chamber therein;

an actuable sealing device associated with said transport container for selectively sealing said core sample transport chamber to form a substantially pressure tight chamber within said transport container when the core sample is contained therein; and a transferring device, for transferring the core sample while under pressure, having a proximal end configured to mate with a distal end of the pressurized core retrieval chamber and configured for forcing the core sample contained within said pressurizable core retrieval chamber into said core sample transport chamber.

2. The apparatus of claim 1, wherein said transferring device comprises an extendable member for extending through the pressurizable core retrieval chamber to force the core sample therefrom and into the core sample transport chamber of said transport container.

3. The apparatus of claim 2, wherein said extendable member is hydraulically actuatable.

4. The apparatus of claim 2, wherein said extendable member is comprised of a plurality of telescoping members extendable relative to one another.

5. The apparatus of claim 4, wherein when said plurality of telescoping members are extended, at least a portion of said extendable member extends through the pressurized core chamber and through said actuable sealing device.

6. The apparatus of claim 1, wherein said core sample transport chamber of said transport container has an internal diameter substantially the same as an inside diameter of the pressurizable core retrieval chamber.

7. The apparatus of claim 1, wherein said transport container further includes means for regulating the pressure within said transport container.

8. The apparatus of claim 1, wherein said actuable sealing device comprises a ball valve assembly secured proximate the distal end of said transport container.

9. A method of transferring a core sample from a core retrieval chamber under pressure, comprising:

obtaining a core retrieval chamber having a pressurized core sample contained therein;

attaching a transport container to a first end of the core retrieval chamber;

attaching a transferring device to a second end of the core retrieval chamber;

opening the first end of the core retrieval chamber;

opening the second end of the core retrieval chamber;

forcing the pressurized core sample from the core retrieval chamber into the transport container with the transferring device while maintaining pressure on the core sample; and sealing the transport container around the pressurized core sample.

10. The method of claim 9, wherein said opening the first end comprises opening a sealing device.

11. The method of claim 9, wherein said opening the first end comprises releasing a sealing plug.

12. The method of claim 9, wherein said opening the second end comprises actuating an externally actuable valve.

13. The method of claim 12, wherein said externally actuable valve comprises a ball valve.

14. The method of claim 9, wherein said forcing comprises extending an elongate member through said core retrieval chamber and into said transport container.

15. The method of claim 9, wherein said sealing the transport container comprises closing an externally actuable valve.

16. An apparatus for transferring a core sample from a pressurized core retrieval chamber and for transporting the core sample, comprising:

a pressurizable core retrieval chamber configured for obtaining and maintaining a pressurized core sample;

a transport container having a distal end configured to mate with a proximal end of the pressurized core retrieval chamber;

an actuable sealing device associated with said transport container for selectively forming a substantially pressure tight chamber within said transport container; and a transferring device having a proximal end configured to mate with a distal end of the pressurized core retrieval chamber, said transferring device comprising an extendable member for extending through the pressurized core chamber to force the core sample therefrom and into the transport container, said extendable member comprising a plurality of telescoping members extendable relative to one another such that at least a portion of said extendable member extends through the pressurized core chamber and through said sealing device.

17. The apparatus of claim 16, wherein said transport container has an internal diameter substantially the same as an inside diameter of the pressure the core chamber.

18. The apparatus of claim 16, wherein said transport container further includes means for regulating the pressure within said transport container.

19. The apparatus of claim 16, wherein said actuable sealing device comprises a ball valve assembly secured proximate the distal end of said transport container.

20. The apparatus of claim 16, wherein said transferring device is hydraulically actuated.

* * * * *

UNITED STATES PATENT AND TRADEMARK OFFICE

CERTIFICATE OF CORRECTION

PATENT NO. : 6,305,482 B1
DATED : October 23, 2001
INVENTOR(S) : Rémy Ruppel et al.

It is certified that error appears in the above-identified patent and that said Letters Patent is hereby corrected as shown below:

Title page,
"[30] Foreign Application Priority Data
Mar. 7, 1996 (FR) ..... 96 03779"
should read
-- [30] Foreign Application Priority Data
Mar. 27, 1996 (FR) ..... 96 03779 --.

Signed and Sealed this

Thirtieth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,305,482 B1
DATED : October 23, 2001
INVENTOR(S) : James T. Aumann et al.

It is certified that error appears in the above-identified patent and that said Letters Patent is hereby corrected as shown below:

This certificate supersedes Certificate of Correction issued April 30, 2002, the number was erroneously mentioned and should be deleted since no certificate of correction was granted.

Signed and Sealed this

Third Day of September, 2002

*Attest:*

*Attesting Officer*

JAMES E. ROGAN
*Director of the United States Patent and Trademark Office*